US011480176B2

(12) United States Patent
Lepak et al.

(10) Patent No.: US 11,480,176 B2
(45) Date of Patent: Oct. 25, 2022

(54) SCROLL COMPRESSOR WITH ECONOMIZER INJECTION

(71) Applicant: TRANE INTERNATIONAL INC., Davidson, NC (US)

(72) Inventors: Derrick Lepak, La Crosse, WI (US); Torin Allan Betthauser, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 298 days.

(21) Appl. No.: 16/912,849

(22) Filed: Jun. 26, 2020

(65) Prior Publication Data

US 2020/0408209 A1 Dec. 31, 2020

Related U.S. Application Data

(63) Continuation-in-part of application No. 16/457,273, filed on Jun. 28, 2019, now Pat. No. 11,371,505.

(51) Int. Cl.

| | |
|---|---|
| ***F04C 18/02*** | (2006.01) |
| ***F04C 23/00*** | (2006.01) |
| *F04C 27/00* | (2006.01) |

(52) U.S. Cl.

CPC ..... *F04C 18/0215* (2013.01); *F04C 23/008* (2013.01); *F04C 18/0261* (2013.01); (Continued)

(58) Field of Classification Search

CPC ..... F04C 18/0215; F04C 18/0261; F04C 23/008; F04C 27/005; F04C 2240/30; (Continued)

(56) References Cited

U.S. PATENT DOCUMENTS 6,293,776 B1 * 9/2001 Hahn ..... F04C 18/0215 418/55.6
6,413,058 B1 * 7/2002 Williams ..... F04C 28/16 417/440

(Continued)

FOREIGN PATENT DOCUMENTS

CN 2503231 Y 7/2002
CN 203201801 U 9/2013

(Continued)

OTHER PUBLICATIONS

Extended European Search Report; European Patent Application No. 20182682.3, dated Sep. 29, 2020 (7 pages).

(Continued)

*Primary Examiner* — Emmanuel E Duke
(74) *Attorney, Agent, or Firm* — Hamre, Schumann, Mueller & Larson, P.C.

(57) ABSTRACT

A scroll compressor includes a compressor housing, an orbiting scroll member, a non-orbiting scroll member, an economizer injection inlet, and a discharge outlet. The orbiting scroll member and the non-orbiting scroll member are disposed within the compressor housing. The orbiting scroll member and the non-orbiting scroll member are intermeshed thereby forming a compression chamber within the compressor housing. The non-orbiting scroll includes a plurality of compression inlet ports. An economizer injection inlet is formed through the compressor housing and in fluid communication with the compression chamber via the compression inlet ports. The discharge outlet is in fluid communication with the compression chamber.

20 Claims, 12 Drawing Sheets

(52) U.S. Cl.
CPC ..... *F04C 27/005* (2013.01); *F04C 2240/30* (2013.01); *F25B 2400/13* (2013.01)

(58) Field of Classification Search
CPC .. F04C 29/0014; F04C 29/12; F25B 2400/13; F24F 5/0003
See application file for complete search history.

(56) References Cited

U.S. PATENT DOCUMENTS

| | | | |
|---|---|---|---|
| 6,474,087 | B1 | 11/2002 | Lifson |
| 6,773,242 | B1 | 8/2004 | Perevozchikov |
| 7,100,386 | B2 | 9/2006 | Lifson et al. |
| 7,201,567 | B2 | 4/2007 | Wiertz et al. |
| 7,854,137 | B2 | 12/2010 | Lifson et al. |
| 8,303,279 | B2 | 11/2012 | Hahn |
| 9,239,054 | B2 | 1/2016 | Ignatiev et al. |
| 2006/0228243 | A1 | 10/2006 | Sun et al. |
| 2007/0245732 | A1 | 10/2007 | Uno et al. |
| 2011/0058971 | A1* | 3/2011 | Hahn ..... F04C 18/0215 62/199 |
| 2014/0072466 | A1* | 3/2014 | Akei ..... F04C 28/265 418/55.1 |
| 2014/0134030 | A1* | 5/2014 | Stover ..... F01C 1/0215 418/55.1 |
| 2019/0101120 | A1* | 4/2019 | Perevozchikov ..... F04C 28/24 |

FOREIGN PATENT DOCUMENTS

| | | |
|---|---|---|
| DE | 102007017770 B4 | 7/2014 |
| JP | 2017-101592 | 6/2017 |

OTHER PUBLICATIONS

Extended European Search Report issued in European Patent Application No. 22152106.5, dated May 23, 2022 (9 pages).

* cited by examiner

SCROLL COMPRESSOR WITH ECONOMIZER INJECTION

FIELD

This disclosure relates generally to a scroll compressor. More specifically, this disclosure relates to providing economizer flow into a scroll compressor in a heating, ventilation, air conditioning, and refrigeration (HVACR) system.

BACKGROUND

A scroll compressor is one type of compressor. Scroll compressors generally include a pair of scroll members which orbit relative to each other to compress air or a refrigerant. A typical scroll compressor includes a first, stationary scroll member having a base and a generally spiral wrap extending from the base and a second, orbiting scroll member having a base and a generally spiral wrap extending from the base. The spiral wraps of the first and second orbiting scroll members are interleaved, creating a series of compression chambers. The second, orbiting scroll member is driven to orbit the first, stationary scroll member by a rotating shaft. Some scroll compressors employ an eccentric pin on the rotating shaft that drives the second, orbiting scroll member.

SUMMARY

This disclosure relates generally to a scroll compressor. More specifically, this disclosure relates to providing economizer flow into a scroll compressor in a heating, ventilation, air conditioning, and refrigeration (HVACR) system.

A scroll compressor includes a compressor housing, an orbiting scroll member, a non-orbiting scroll member, an economizer injection inlet, and a discharge outlet. The orbiting scroll member and the non-orbiting scroll member are disposed within the compressor housing. The orbiting scroll member and the non-orbiting scroll member are intermeshed thereby forming a compression chamber within the compressor housing. The non-orbiting scroll member includes a plurality of compression inlet ports. An economizer injection inlet is formed through the compressor housing and in fluid communication with the compression chamber via the compression inlet ports. The discharge outlet is in fluid communication with the compression chamber.

A heating, ventilation, air conditioning, and refrigeration (HVACR) system is disclosed. The HVACR system includes a refrigerant circuit. The refrigerant circuit includes a compressor, a condenser, an expansion device, an economizer, and an evaporator, fluidly connected, wherein a working fluid flows therethrough. The compressor is a scroll compressor. The scroll compressor includes a compressor housing, an orbiting scroll member, a non-orbiting scroll member, an economizer injection inlet, and a discharge outlet. The orbiting scroll member and the non-orbiting scroll member are disposed within the compressor housing. The orbiting scroll member and the non-orbiting scroll member are intermeshed thereby forming a compression chamber within the compressor housing. The non-orbiting scroll member includes a plurality of compression inlet ports. An economizer injection inlet is formed through the compressor housing and in fluid communication with the compression chamber via the compression inlet ports. The discharge outlet is in fluid communication with the compression chamber.

A scroll compressor is disclosed. The scroll compressor includes a compressor housing having a plurality of portions including an upper housing portion and a lower housing portion. An orbiting scroll member is disposed within the compressor housing. A non-orbiting scroll member is disposed within the housing. The orbiting scroll member and the non-orbiting scroll member are intermeshed thereby forming a compression chamber within the compressor housing. The non-orbiting scroll member includes a plurality of compression inlet ports. An economizer injection inlet is formed through the upper housing portion and in fluid communication with the compression chamber via the compression inlet ports. A discharge outlet is in fluid communication with the compression chamber and is formed through the upper housing. The upper housing portion and the non-orbiting scroll member are sealingly engaged thereby forming an intermediate pressure chamber therebetween.

BRIEF DESCRIPTION OF THE DRAWINGS

References are made to the accompanying drawings that form a part of this disclosure, and which illustrate embodiments in which the systems and methods described in this Specification can be practiced.

Like reference numbers represent like parts throughout.

DETAILED DESCRIPTION

Figure 1:
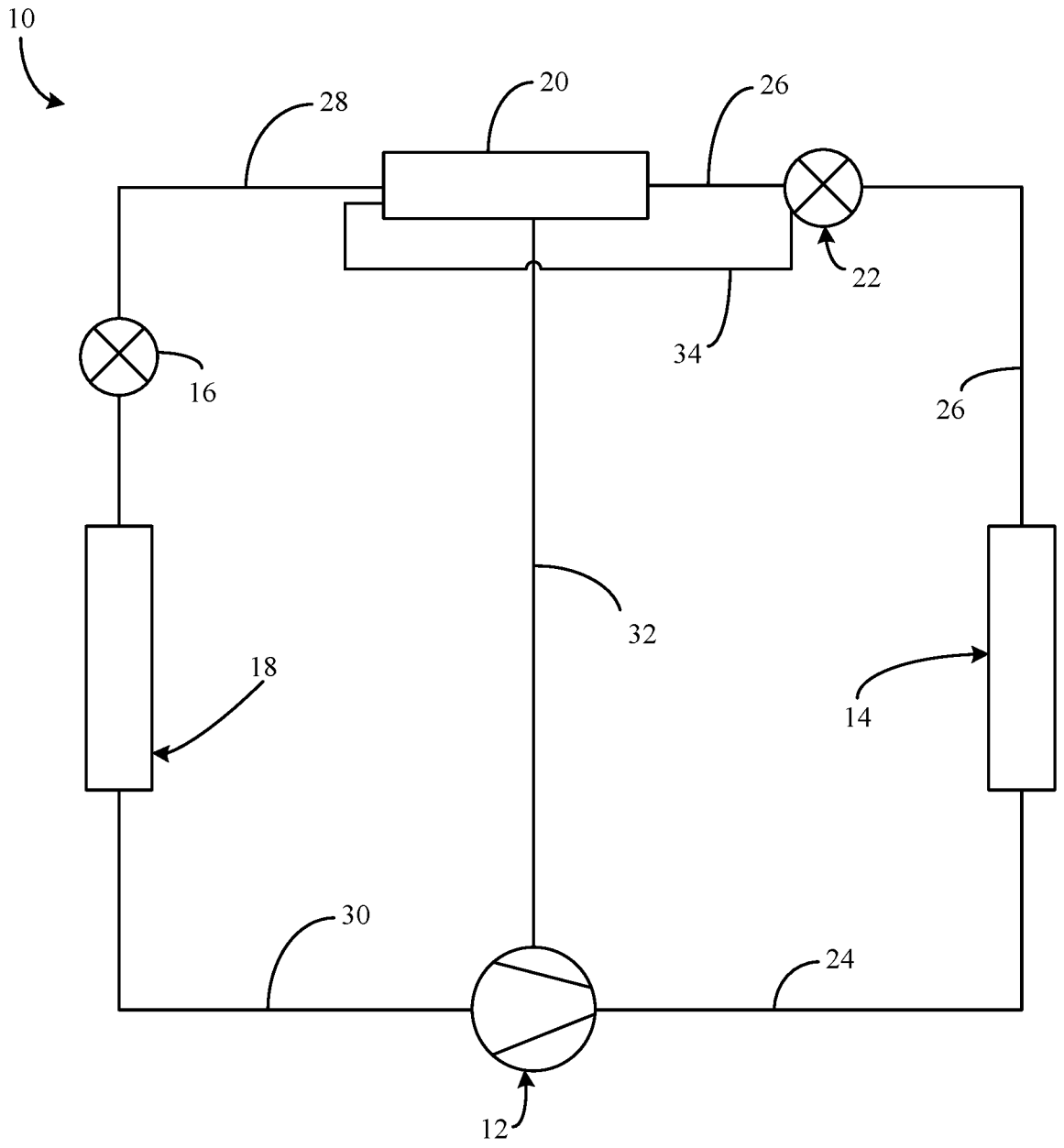
FIG. 1 is a schematic diagram of a refrigerant circuit, according to an embodiment.

This disclosure relates generally to a scroll compressor. More specifically, this disclosure relates to providing economizer flow into a scroll compressor in a heating, ventilation, air conditioning, and refrigeration (HVACR) system.

In an HVACR system, an economizer can be included. The economizer can receive a working fluid in a mixed state (e.g., a mixture of a liquid working fluid and a gaseous working fluid) and can provide a portion of the working fluid to a compressor in the HVACR system. The working fluid from the economizer can be provided to the compressor at an intermediate pressure and can, for example, include the gaseous portion of the working fluid received by the economizer. Inclusion of the economizer can, for example, increase an efficiency of the HVACR system, increase a capacity of the HVACR system, or increase both efficiency and a capacity of the HVACR system.

In an HVACR system where the compressor is, for example, a scroll compressor, providing the working fluid from the economizer to the compressor can be challenging. For example, the insertion of the intermediate pressure working fluid typically requires complex connections to ensure the working fluid is provided to an appropriate location in the compression process (e.g., a closed compression pocket). The complex connections can cause difficulties during the compressor manufacturing and assembly process. Additionally, the complex connections can result in additional pressure drop of the working fluid as it is provided to the compressor. The additional pressure drop can, for example, reduce an effectiveness of the economizer.

Embodiments of this disclosure are directed to a scroll compressor including an intermediate pressure chamber for providing working fluid to the compressor from the economizer. The intermediate pressure chamber can be provided at a location between the non-orbiting scroll member and an outermost cap of the scroll compressor. The intermediate pressure chamber is a simpler design that can result in a reduced pressure drop relative to prior scroll compressors. As a result of the embodiments described in this Specification, an effectiveness of the economizer can be increased, resulting in an increased amount of subcooling in the condenser and a larger capacity for the evaporator in the HVACR system. Additionally, the simpler assembly can result in reduced manufacturing efforts.

Embodiments of this disclosure are realized through providing the working fluid from the economizer to the compressor at a location that typically includes a higher pressure working fluid (e.g., at a discharge pressure). In an embodiment, this can include an unconventional usage of the typical discharge outlet of the scroll compressor. Such an embodiment can include repurposing what has been previously used as the discharge outlet for the scroll compressor so that working fluid from the economizer can be provided to the compressor through the discharge outlet (i.e., working fluid enters the discharge outlet and is provided to the scroll members for compression) instead of fluid being output from the scroll compressor at the discharge outlet. Other embodiments can include providing a new discharge outlet location and a new economizer injection inlet location that generally is at a location of the scroll compressor that is typically at the discharge pressure.

Embodiments of this disclosure can have the intermediate pressure chamber including a helical channel that fluidly connects an economizer injection inlet to a compression inlet port. The helical channel may have an inner surface that is continuously curved which reduces sudden directional changes of a flow path of a working fluid flowing through the helical channel. Reducing sudden directional changes of the flow path reduces the pressure drop and/or the velocity reduction within the flow path. The continuously curved inner surface reduces the pressure drop and/or velocity reduction of the working fluid between the economizer injection inlet and the compressor inlet port.

Embodiments of this disclosure may also be utilized in HVACR systems utilizing new-age refrigerants which typically have a reduced capacity. The inclusion of the economizer and the improved delivery of the working fluid from the economizer to the compressor can, for example, boost capacity of the HVACR system, thereby reducing an impact of switching to the new age refrigerants.

FIG. 1 is a schematic diagram of a refrigerant circuit 10, according to an embodiment. The refrigerant circuit 10 generally includes a compressor 12, a condenser 14, an expansion device 16, an evaporator 18, an economizer 20, and an expansion device 22 fluidly connected to form a closed fluid circuit. In an embodiment, the expansion device 16 can be referred to as the main expansion device 16 and the expansion device 22 can be referred to as the economizer expansion device 22.

The refrigerant circuit 10 is an example and can be modified to include additional components. For example, in an embodiment, the refrigerant circuit 10 can include other components such as, but not limited to, one or more flow control devices, a receiver tank, a dryer, a suction-liquid heat exchanger, or the like.

The refrigerant circuit 10 can generally be applied in a variety of systems used to control an environmental condition (e.g., temperature, humidity, air quality, or the like) in a space (generally referred to as a conditioned space). Examples of such systems include, but are not limited to, HVACR systems, transport refrigeration systems, or the like.

The compressor 12, condenser 14, expansion device 16, evaporator 18, economizer 20, and expansion device 22 are fluidly connected via refrigerant lines 24, 26, 28, 30, 32, and 34. In an embodiment, the refrigerant lines 24, 26, 28, 30, 32, and 34 can alternatively be referred to as the refrigerant conduits 24, 26, 28, 30, 32, and 34 or the like.

In an embodiment, the refrigerant circuit 10 can be configured to be a cooling system (e.g., an air conditioning system) capable of operating in a cooling mode. In an embodiment, the refrigerant circuit 10 can be configured to be a heat pump system that can operate in both a cooling mode and a heating/defrost mode.

The refrigerant circuit 10 can operate according to generally known principles. The refrigerant circuit 10 can be configured to heat or cool a gaseous process fluid (e.g., a heat transfer medium or fluid such as, but not limited to, air or the like), in which case the refrigerant circuit 10 may be generally representative of an air conditioner or heat pump.

In operation, the compressor 12 compresses a working fluid (e.g., a heat transfer fluid such as a refrigerant or the like) from a relatively lower pressure gas (e.g., suction pressure) to a relatively higher-pressure gas (e.g., discharge pressure). In an embodiment, the compressor 12 can be a positive displacement compressor. In an embodiment, the positive displacement compressor can be a screw compressor, a scroll compressor, a reciprocating compressor, or the like.

The relatively higher-pressure gas is also at a relatively higher temperature, which is discharged from the compressor 12 and flows through refrigerant line 24 to the condenser 14. The working fluid flows through the condenser 14 and rejects heat to a process fluid (e.g., water, air, etc.). The cooled working fluid, which is now in a liquid form, flows to the expansion device 22 via the refrigerant line 26. The expansion device 22 reduces the pressure of the working fluid. As a result, a portion of the working fluid is converted to a gaseous form.

An "expansion device" may also be referred to as an expander. In an embodiment, the expander may be an expansion valve, expansion plate, expansion vessel, orifice, or the like, or other such types of expansion mechanisms. It is to be appreciated that the expander may be any type of expander used in the field for expanding a working fluid to cause the working fluid to decrease in temperature.

The working fluid, which is now in a mixed liquid and gaseous form flows to the economizer 20 via the refrigerant lines 26 and 34. The gaseous portion of the mixed liquid and gaseous working fluid flows via the refrigerant line 34 and the liquid portion of the mixed liquid and gaseous working fluid flows via the refrigerant line 26. In an embodiment, the mixed liquid and gaseous working fluid can flow to the economizer 20 via a single refrigerant line (e.g., the refrigerant line 26), and the economizer 20 can result in a separate flow of the liquid portion of the working fluid flowing from the economizer 20 via the refrigerant line 28 and the gaseous portion of the working fluid flowing to the compressor 12 via the refrigerant line 32.

From the economizer 20, a gaseous portion of the working fluid flows from the economizer 20 to the compressor 12 via the refrigerant line 32. The gaseous portion of the working fluid that flows to the compressor 12 is at an intermediate pressure between the relatively lower pressure working fluid and the relatively higher pressure working fluid (e.g., a pressure that is between the discharge pressure and the suction pressure).

A liquid portion of the working fluid flows from the economizer 20 to the expansion device 16 via the refrigerant line 28. The expansion device 16 reduces the pressure of the working fluid. The working fluid flows through the evaporator 18 and absorbs heat from a process fluid (e.g., water, air, etc.), heating the working fluid, and converting it to a gaseous form. The gaseous working fluid then returns to the compressor 12 via the refrigerant line 30. The above-described process continues while the refrigerant circuit is operating, for example, in a cooling mode (e.g., while the compressor 12 is enabled).

Figure 2:
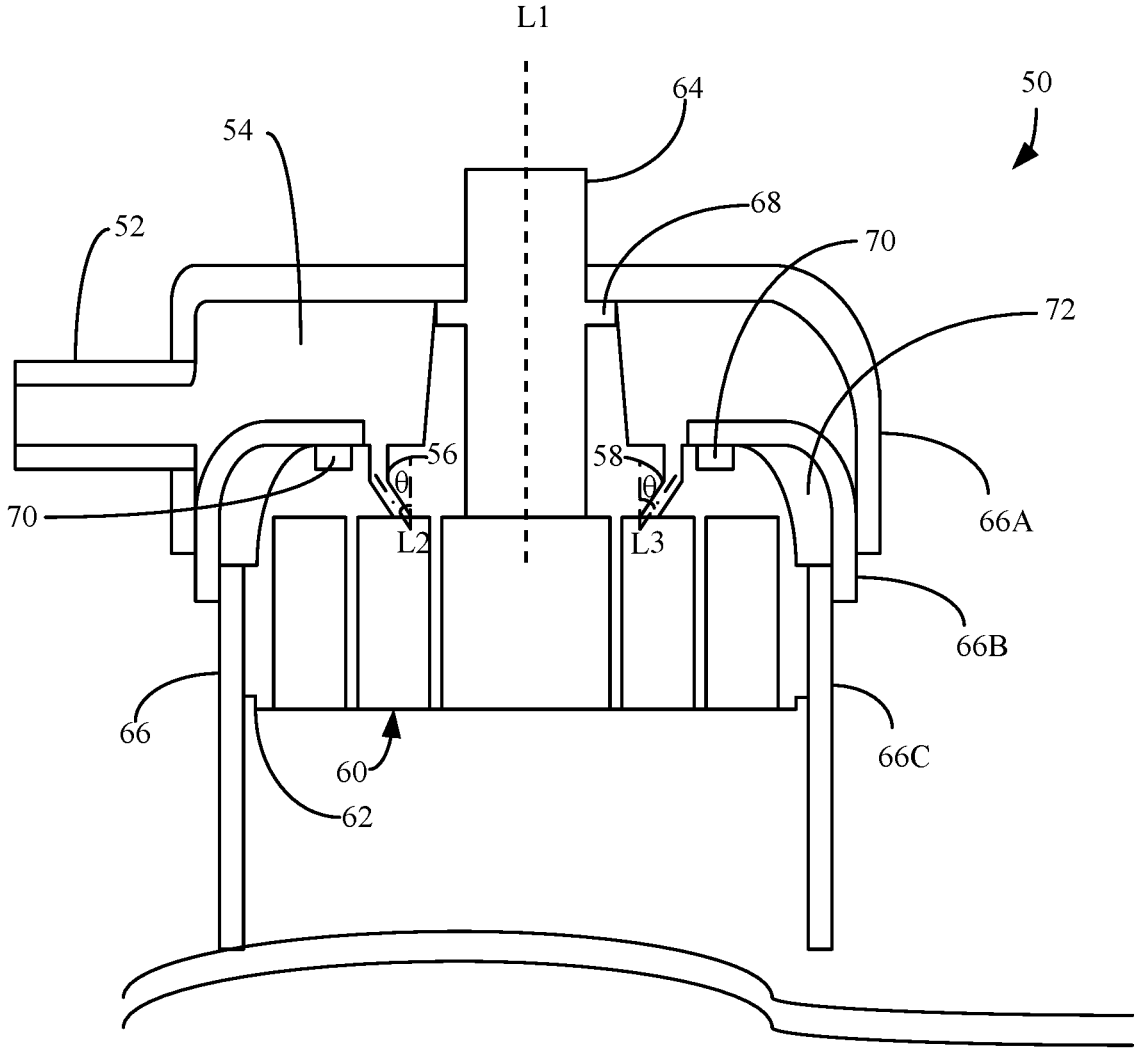
FIG. 2 is a schematic diagram of a portion of a compressor, according to an embodiment.

FIG. 2 is a schematic diagram of a portion of a compressor 50, according to an embodiment.

The compressor 50 can be used in the refrigerant circuit 10 (FIG. 1) as the compressor 12. It is to be appreciated that the compressor 50 can also be used for purposes other than in a refrigerant circuit. For example, the compressor 50 can be used to compress air or gases other than a heat transfer fluid (e.g., natural gas, etc.). It is to be appreciated that the compressor 50 includes additional features that are not described in detail in this Specification. For example, the compressor 50 includes a lubricant sump for storing lubricant to be introduced to the moving features of the compressor 50.

The illustrated compressor 50 is a single-stage scroll compressor. More specifically, the illustrated compressor 50 is a single-stage vertical scroll compressor. It is to be appreciated that the principles described in this Specification are not intended to be limited to single-stage scroll compressors and that they can be applied to multi-stage scroll compressors having two or more compression stages. Generally, the embodiments as disclosed in this Specification are suitable for a compressor with a vertical or a near vertical crankshaft (not shown in FIG. 2, see FIGS. 3 and 5). It is to be appreciated that the embodiments may also be applied to a horizontal compressor.

The compressor 50 includes an economizer injection inlet 52 that leads to an intermediate pressure chamber 54. The economizer injection inlet 52 can be a tube, connection, other fitting, or the like. The economizer injection inlet 52 can accordingly be alternatively referred to as the economizer injection tube 52, the economizer injection connection 52, or the economizer injection connection 52.

In prior compressors, the economizer injection inlet 52 is generally a discharge outlet and the intermediate pressure chamber 54 is a high pressure (e.g., discharge pressure) chamber.

In operation, working fluid in a gaseous form and at an intermediate pressure can be received at the economizer injection inlet 52 from the economizer (e.g., economizer 20 and refrigerant line 32 in FIG. 1). The working fluid is provided to the intermediate pressure chamber 54, and subsequently to a compression chamber 60 (e.g., in closed pressure pockets) in the compression chamber 60 via compression inlet ports 56, 58.

The compression inlet ports 56, 58 are formed in a non-orbiting scroll member 62 (alternatively can be referred to as the fixed scroll 62) of the compressor 50. Working fluid that has been compressed in the compression chamber 60 is provided from the compressor 50 via discharge outlet 64. The compressed working fluid (e.g., at a discharge pressure) is then provided to the condenser (e.g., condenser 14 via refrigerant line 24 in FIG. 1).

The compressor 50 includes a housing 66 having a plurality of portions 66A-66C. The housing 66 can alternatively be referred to as the enclosure 66 or the like. The upper portion 66A of the housing 66 is an outermost housing of the compressor 50 and can be referred to as the outer cap 66A. The intermediate portion 66B of the housing 66 is disposed between the compression chamber 60 and the upper portion 66A and can be referred to as the intermediate cap 66B. The intermediate portion 66B and the upper portion 66A of the housing 66 form a volume therebetween, which is the intermediate pressure chamber 54. The lower portion 66C of the housing 66 provides the remainder of the housing 66 for the compressor 50.

A discharge seal 68 (e.g., a gasket, O-ring, face seal, or the like) and an intermediate seal 70 (e.g., a gasket, O-ring, face seal, or the like) can function to isolate the intermediate pressure chamber 54 from the discharge outlet 64 (e.g., working fluid at a discharge pressure) and a suction chamber 72 (e.g., working fluid at a suction pressure). The discharge seal 68 can be sealingly engaged with the non-orbiting scroll member 62 and the upper portion 66A of the housing 66. The intermediate seal 70 can be sealingly engaged with the non-orbiting scroll member 62 and the intermediate portion 66B of the housing 66.

In operation, the compressor 50 can receive an intermediate pressure working fluid via the economizer injection inlet 52 and provide that working fluid to the compression chamber 60 via the compression inlet ports 56, 58, where the working fluid is compressed and ultimately discharged via the discharge outlet 64.

In an embodiment, to ensure that working fluid is flowing into the compression chamber 60 via the compression inlet ports 56, 58, and not outward, the pressure of the working fluid at the compression inlet ports 56, 58 may generally be higher than the pressure of the working fluid in the compression chamber 60. In an embodiment, because pressure of the compression chamber 60 is cyclic in a scroll compressor, the pressure of the compression chamber 60 at the location of the compression inlet ports 56, 58 may briefly be less than the pressure of the working fluid at the compression inlet ports 56, 58. However, the intermediate pressure chamber 54 may reduce an impact of any pressure wave that could flow backwards from the normal flow direction. In an embodiment, a one-way valve (e.g., a check valve) could be included to ensure that working fluid cannot flow backwards from the normal flow direction.

The specific location of the compression inlet ports 56, 58 with respect to the compression process can be varied.

In an embodiment, the location of the compression inlet ports 56, 58 can be selected so that the pressure in the compression chamber 60 is relatively near the suction pressure (e.g., at a location in which compression is just beginning). In the illustrated embodiment, this is a location at a relatively outer extent of the compression chamber 60. In such an embodiment, the provision of the working fluid to the compression process can increase a capacity of the HVACR system, but may also increase energy required, which may reduce an efficiency of the HVACR system.

In an embodiment, the location of the compression inlet ports 56, 58 can be selected so that the pressure in the compression chamber 60 is relatively near the discharge pressure (e.g., at a location near the discharge). In the illustrated embodiment, this is a location at a relatively inner extent of the compression chamber 60. In such an embodiment, the provision of the working fluid to the compression process can increase the efficiency of the HVACR system, but may only slightly improve the capacity of the HVACR system.

In an embodiment, the location of the compression inlet ports 56, 58 can be selected so that the pressure in the compression chamber 60 is between the suction pressure and the discharge pressure. The selection of the location of the compression inlet ports 56, 58 can accordingly be balanced between increasing capacity and maintaining efficiency. Such a location may be selected based on, for example, modeling the anticipated efficiency and capacity changes, testing to determine the optimal location, or combinations thereof.

The compression inlet ports 56, 58 can be bored or otherwise drilled or formed in the non-orbiting scroll member 62 of the compressor 50. In an embodiment, the non-orbiting scroll member 62 can be cast or otherwise manufactured to include the compression inlet ports 56, 58. The compression inlet ports 56, 58 can be designed to minimize a pressure drop of the working fluid having an intermediate pressure. For example, the diameter, the length, and combinations thereof can be controlled to provide the working fluid at, for example, a desired flowrate. Further, an orientation of the compression inlet ports 56, 58 can be controlled. For example, the compression inlet ports 56, 58 are oriented at an angle θ relative to a longitudinal axis L1 of the compressor 50. The angle θ can be measured along a longitudinal axis L2, L3 of the compression inlet ports 56, 58. In an embodiment, the angle θ can vary. In an embodiment, the angle θ can be 0°. In an embodiment, an angle of the compression inlet ports 56, 58 can also be varied with respect to a direction into or out from the page.

Figure 3:
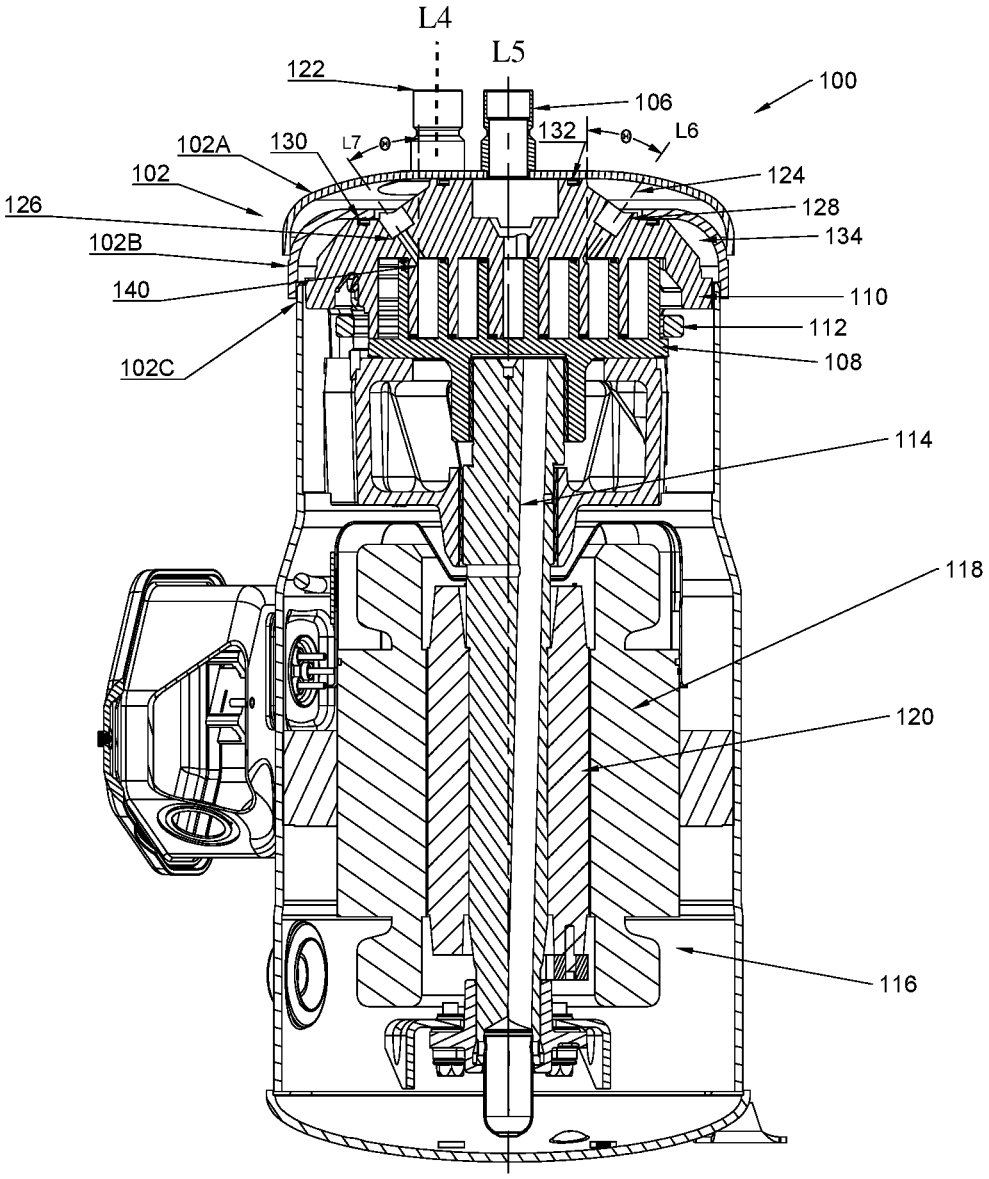
FIG. 3 is a sectional view of a compressor, according to an embodiment.

FIG. 3 is a sectional view of a compressor 100, according to an embodiment. It is to be appreciated that features of the compressor 100 can be the same as or similar to the features from the compressor 50, according to an embodiment.

The compressor 100 can be used in the refrigerant circuit 10 (FIG. 1) as the compressor 12. It is to be appreciated that the compressor 100 can also be used for purposes other than in a refrigerant circuit. For example, the compressor 100 can be used to compress air or gases other than a heat transfer fluid (e.g., natural gas, etc.). It is to be appreciated that the compressor 100 includes additional features that are not described in detail in this Specification. For example, the compressor 100 includes a lubricant sump for storing lubricant to be introduced to the moving features of the compressor 100.

The illustrated compressor 100 is a single-stage scroll compressor. More specifically, the illustrated compressor 100 is a single-stage vertical scroll compressor. It is to be appreciated that the principles described in this Specification are not intended to be limited to single-stage scroll compressors and that they can be applied to multi-stage scroll compressors having two or more compression stages. Generally, the embodiments as disclosed in this Specification are suitable for a compressor with a vertical or a near vertical crankshaft (e.g., crankshaft 114). It is to be appreciated that the embodiments may also be applied to a horizontal compressor.

The compressor 100 is illustrated in sectional side view. The compressor 100 includes a housing 102. The housing 102 includes an upper portion 102A, an intermediate portion 102B, and a lower portion 102C. The upper portion 102A of the housing 102 is an outermost housing of the compressor 100 and can alternatively be referred to as the outer cap 102A. The intermediate portion 102B of the housing 102 is disposed between the compression chamber 140 and the upper portion 102A of the housing 102, and can be referred to as the intermediate cap 102B. The intermediate portion 102B and the upper portion 102A form a volume therebetween, which is the intermediate pressure chamber 124. The lower portion 102C provides the remainder of the housing 102 for the compressor 100.

The compressor 100 includes a suction inlet (not shown in the sectional side view of FIG. 3) and a discharge outlet 106. In the illustrated embodiment, the discharge outlet 106 is oriented in line with a driveshaft 114 of the compressor 100. In the illustrated embodiment, the discharge outlet 106 is therefore oriented such that working fluid is discharged vertically upward (with respect to the page). It is to be appreciated that other orientations of the discharge outlet 106 may be possible (e.g., horizontal, angled, or the like).

The compressor 100 includes an orbiting scroll member 108 and a non-orbiting scroll member 110. The non-orbiting scroll member 110 can alternatively be referred to as, for example, the stationary scroll 110, the fixed scroll 110, or the like. The non-orbiting scroll member 110 is aligned in meshing engagement with the orbiting scroll member 108 by an Oldham coupling 112.

The compressor 100 includes the driveshaft 114. The driveshaft 114 can alternatively be referred to as the crankshaft 114. The driveshaft 114 can be rotatably driven by, for example, an electric motor 116. The electric motor 116 can generally include a stator 118 and a rotor 120. The driveshaft 114 is fixed to the rotor 120 such that the driveshaft 114 rotates along with the rotation of the rotor 120. The electric motor 116, stator 118, and rotor 120 operate according to generally known principles. The driveshaft 114 can, for example, be fixed to the rotor 120 via an interference fit or the like. The driveshaft 114 can, in an embodiment, be connected to an external electric motor, an internal combustion engine (e.g., a diesel engine or a gasoline engine), or the like. It will be appreciated that in such embodiments the electric motor 116, stator 118, and rotor 120 would not be present in the compressor 100.

The compressor 100 includes an economizer injection inlet 122. The economizer injection inlet 122 is disposed in the upper portion 102A of the housing 102. In the illustrated embodiment, a longitudinal axis LA of the economizer injection inlet 122 is parallel to an axis L5 of the driveshaft 114. The economizer injection inlet 122 is configured to be fluidly connected to an economizer (e.g., the economizer 20 in FIG. 1). In an embodiment, the economizer injection inlet 122 and the discharge outlet 106 can be, for example, machined connections or tubes that are welded to the housing 102. In an embodiment, the housing 102, economizer injection inlet 122, and discharge outlet 106 can be a single piece, unitary construction.

The economizer injection inlet 122 is in fluid communication with an intermediate pressure chamber 124. The intermediate pressure chamber 124 is fluidly connected to compression chamber 140 via a plurality of compression inlet ports 126, 128.

The compression inlet ports 126, 128 are formed in the non-orbiting scroll member 110 of the compressor 100. Working fluid that has been compressed in the compression chamber 140 is provided from the compressor 100 via discharge outlet 106. The compressed working fluid (e.g., at a discharge pressure) is then provided to the condenser (e.g., condenser 14 via refrigerant line 24 in FIG. 1).

A discharge seal 132 (e.g., a gasket, O-ring, face seal, or the like) and an intermediate seal 130 (e.g., a gasket, O-ring, face seal, or the like) can function to isolate the intermediate pressure chamber 124 from the discharge outlet 106 (e.g., working fluid at a discharge pressure) and a suction chamber 134 (e.g., working fluid at a suction pressure). The discharge seal 132 sealingly engages the upper portion 102A of the housing 102 and the non-orbiting scroll member 110. The intermediate seal 130 sealingly engages the intermediate portion 102B of the housing 102 and the non-orbiting scroll member 110.

In operation, the compressor 100 can receive an intermediate pressure working fluid via the economizer injection inlet 122 and provide that working fluid to the compression chamber 140 via the compression inlet ports 126, 128, where the working fluid is compressed and ultimately discharged via the discharge outlet 106.

In an embodiment, to ensure that working fluid is flowing into the compression chamber 140 via the compression inlet ports 126, 128, and not outward, the pressure of the working fluid at the compression inlet ports 126, 128 may generally be higher than the pressure of the working fluid in the compression chamber 140. In an embodiment, because pressure of the compression chamber 140 is cyclic in a scroll compressor, the pressure of the compression chamber 140 at the location of the compression inlet ports 126, 128 may briefly be less than the pressure of the working fluid at the compression inlet ports 126, 128. However, the intermediate pressure chamber 124 may reduce an impact of any pressure wave that could flow backwards from the normal flow direction. In an embodiment, a one-way valve (e.g., a check valve) could be included to ensure that working fluid cannot flow backwards from the normal flow direction.

The specific location of the compression inlet ports 126, 128 with respect to the compression process can be varied.

In an embodiment, the location of the compression inlet ports 126, 128 can be selected so that the pressure in the compression chamber 140 is relatively near the suction pressure (e.g., at a location in which compression is just beginning). In the illustrated embodiment, this is a location at a relatively outer extent of the compression chamber 140. In such an embodiment, the provision of the working fluid to the compression process can increase a capacity of the HVACR system, but may also increase energy required, which may reduce an efficiency of the HVACR system.

In an embodiment, the location of the compression inlet ports 126, 128 can be selected so that the pressure in the compression chamber 140 is relatively near the discharge pressure (e.g., at a location near discharge). In the illustrated embodiment, this is a location at a relatively inner extent of the compression chamber 140. In such an embodiment, the provision of the working fluid to the compression process can increase the efficiency of the HVACR system, but may only slightly improve the capacity of the HVACR system.

In an embodiment, the location of the compression inlet ports 126, 128 can be selected so that the pressure in the compression chamber 140 is between the suction pressure and the discharge pressure. The selection of the location of the compression inlet ports 126, 128 can accordingly be balanced between increasing capacity and maintaining efficiency. Such a location may be selected based on, for example, modeling the anticipated efficiency and capacity changes, testing to determine the optimal location, or combinations thereof.

The compression inlet ports 126, 128 can be bored or otherwise drilled or formed in the non-orbiting scroll member 110 of the compressor 100. In an embodiment, the non-orbiting scroll member 110 can be cast or otherwise manufactured to include the compression inlet ports 126, 128. The compression inlet ports 126, 128 can be designed to minimize a pressure drop of the working fluid having an intermediate pressure. For example, the diameter, the length, and combinations thereof can be controlled to provide the working fluid at, for example, a desired flowrate. Further, an orientation of the compression inlet ports 126, 128 can be controlled. For example, the compression inlet ports 126, 128 are oriented at an angle θ relative to a longitudinal axis L5 of the compressor 100. The angle θ can be measured along a longitudinal axis L6, L7 of the compression inlet ports 126, 128. In an embodiment, the angle θ can vary. In an embodiment, the angle θ can be 0°. In an embodiment, an angle of the compression inlet ports 126, 128 can also be varied with respect to a direction into or out from the page.

Figure 4:
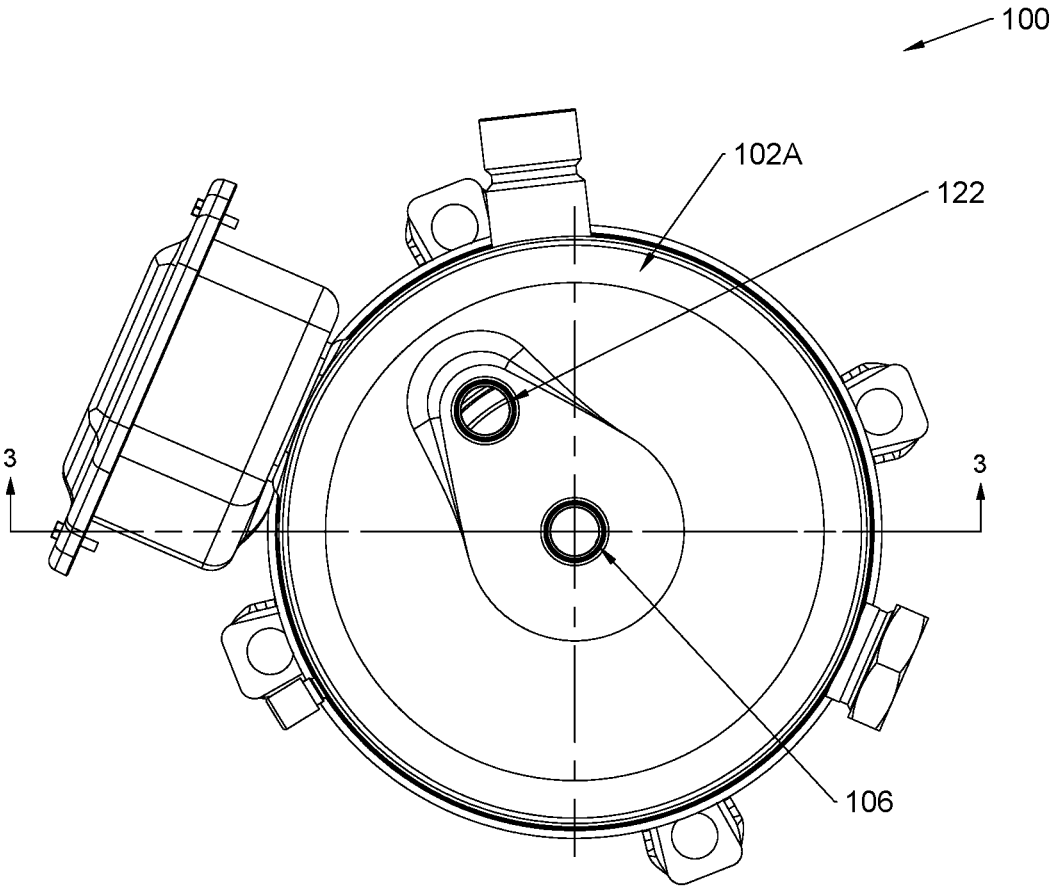
FIG. 4 is a top view of the compressor in FIG. 3, according to an embodiment.

FIG. 4 is a top view of the compressor 100 in FIG. 3, according to an embodiment. As illustrated in FIG. 4, the economizer injection inlet 122 and the discharge outlet 106 are both disposed in the upper portion 102A of the housing 102. The discharge outlet 106 is disposed centrally with respect to the compressor 100. The economizer injection inlet 122 is disposed offset from the center of the compressor 100. Line 3-3 is also shown in FIG. 4, indicating along which line the section of FIG. 3 is displayed.

Figure 5:
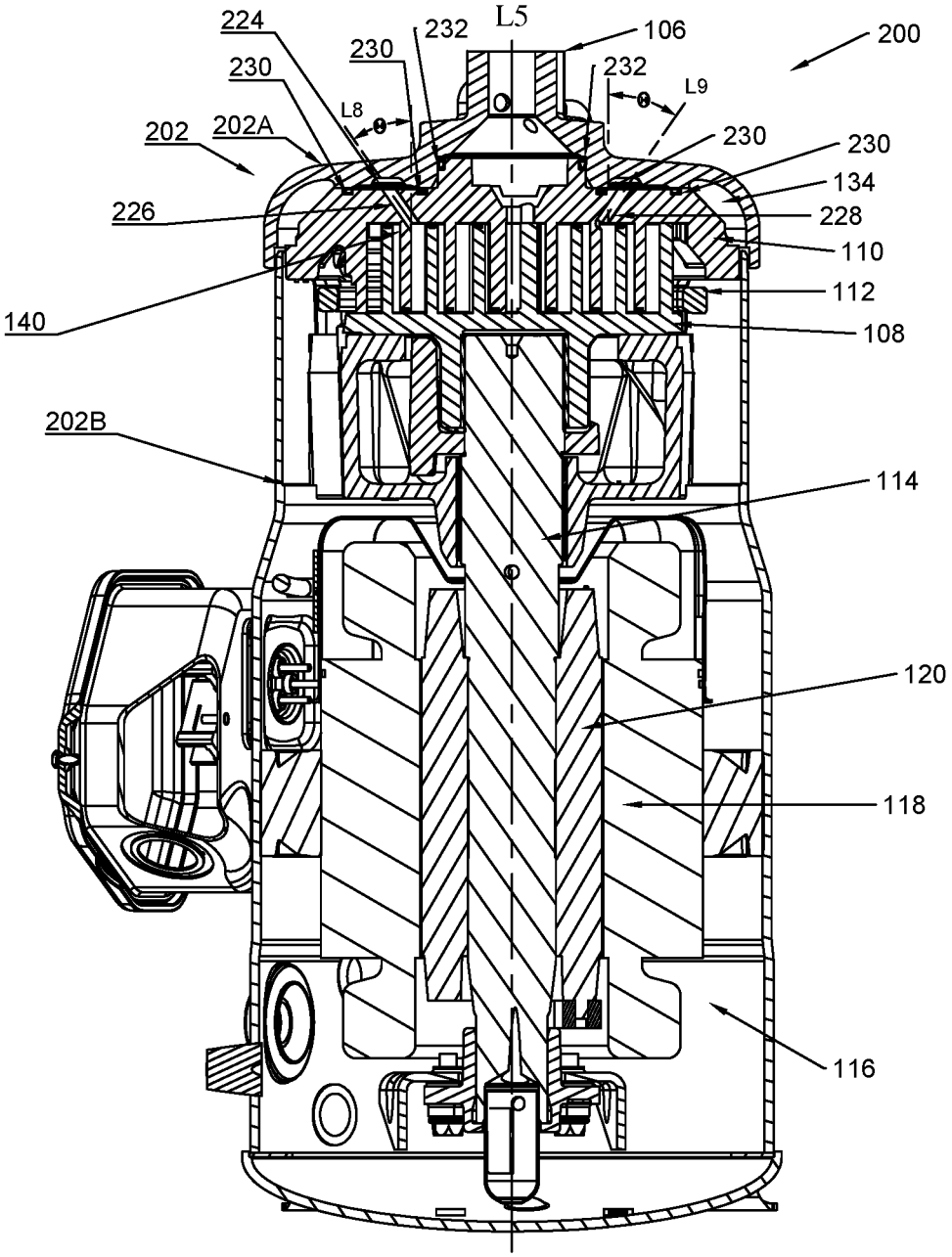
FIG. 5 illustrates a sectional view of a compressor, according to another embodiment.

FIG. 5 is a sectional view of a compressor 200, according to an embodiment. It is to be appreciated that features of the compressor 200 can be the same as or similar to the features from the compressor 50 or the compressor 100, according to an embodiment. For simplicity of this Specification, features identified by like reference numbers will not be described in further detail.

The compressor 200 can be used in the refrigerant circuit 10 (FIG. 1) as the compressor 12. It is to be appreciated that the compressor 200 can also be used for purposes other than in a refrigerant circuit. For example, the compressor 200 can be used to compress air or gases other than a heat transfer fluid (e.g., natural gas, etc.). It is to be appreciated that the compressor 200 includes additional features that are not described in detail in this Specification. For example, the compressor 200 includes a lubricant sump for storing lubricant to be introduced to the moving features of the compressor 200.

The illustrated compressor 200 is a single-stage scroll compressor. More specifically, the illustrated compressor 200 is a single-stage vertical scroll compressor. It is to be appreciated that the principles described in this Specification are not intended to be limited to single-stage scroll compressors and that they can be applied to multi-stage scroll compressors having two or more compression stages. Generally, the embodiments as disclosed in this Specification are suitable for a compressor with a vertical or a near vertical crankshaft (e.g., crankshaft 114). It is to be appreciated that the embodiments may also be applied to a horizontal compressor.

The compressor 200 is illustrated in sectional side view. The compressor 200 includes housing 202. The housing 202 includes an upper portion 202A and a lower portion 202B. The upper portion 202A can alternatively be referred to as the cap 202A. The upper portion 202A is an outermost portion of the housing 202 of the compressor 200. The upper portion 202A and the non-orbiting scroll member 110 form a volume therebetween, which is the intermediate pressure chamber 224. The lower portion 202B provides the remainder of the housing 202 for the compressor 200.

Figure 6:
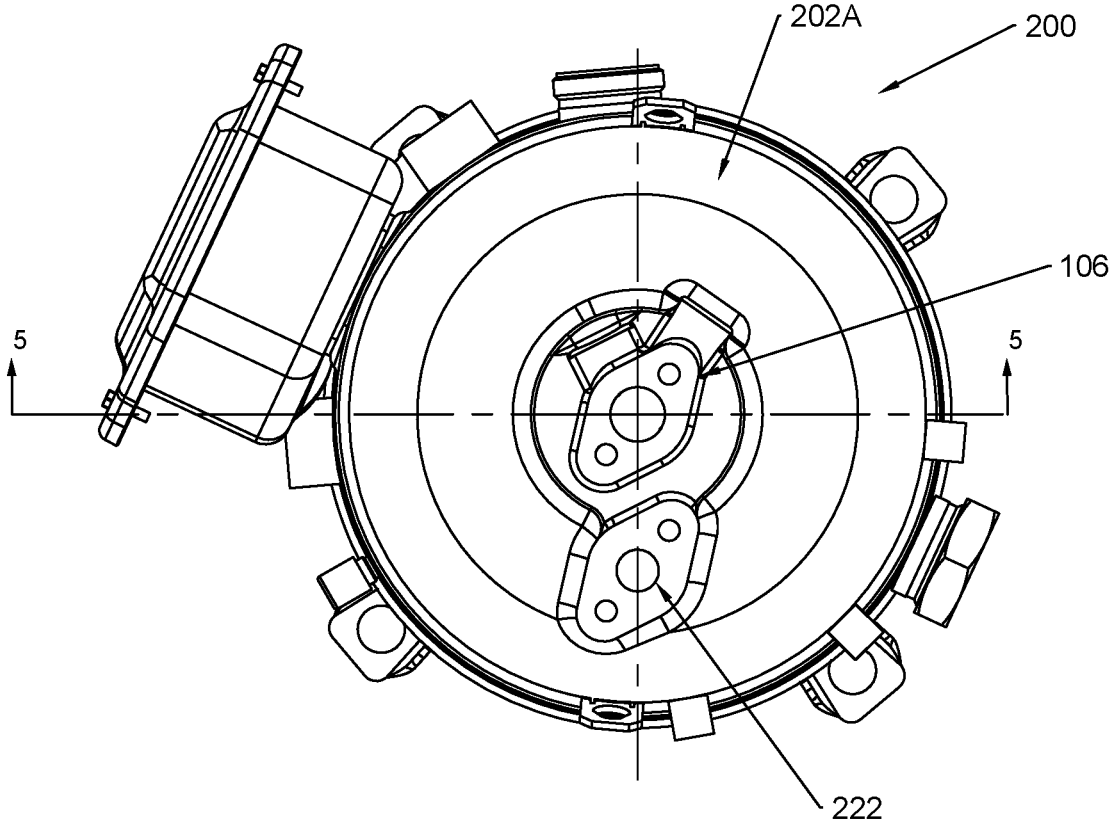
FIG. 6 is a top view of the compressor in FIG. 5, according to an embodiment.

The compressor 200 includes an economizer injection inlet 222 (FIG. 6). The economizer injection inlet 222 is disposed in the upper portion 202A of the housing 202. In the illustrated embodiment, a longitudinal axis of the economizer injection inlet 222 is parallel to an axis of the driveshaft 114. The economizer injection inlet 222 is configured to be fluidly connected to an economizer (e.g., the economizer 20 in FIG. 1). In an embodiment, the economizer injection inlet 222 and the discharge outlet 106 can be, for example, machined connections or tubes that are welded to the housing 202. In an embodiment, the housing 202, economizer injection inlet 122, and discharge outlet 106 can be a single piece, unitary construction.

The economizer injection inlet 222 is in fluid communication with compression chamber 140 via a plurality of compression inlet ports 226, 228. In the illustrated embodiment, the housing portion 202A forms a sealing engagement with the non-orbiting scroll member 110. The compression inlet ports 226, 228 are formed in the non-orbiting scroll member 110 of the compressor 200. Working fluid that has been compressed in the compression chamber 140 is provided from the compressor 200 via discharge outlet 106. The compressed working fluid (e.g., at a discharge pressure) is then provided to the condenser (e.g., condenser 14 via refrigerant line 24 in FIG. 1).

A discharge seal 232 (e.g., a gasket, O-ring, face seal, or the like) and intermediate seals 230 (e.g., a gasket, O-ring, face seal, or the like) can function to isolate the compression inlet ports 226, 228 from the discharge outlet 106 (e.g., working fluid at a discharge pressure) and a suction chamber 134 (e.g., working fluid at a suction pressure). The discharge seal 232 sealingly engages the upper portion 202A of the housing 202 and the non-orbiting scroll member 110. The intermediate seals 230 sealingly engage the upper portion 202A of the housing 202 and the non-orbiting scroll member 110. In the illustrated embodiment, there are two intermediate seals 230. The intermediate seals 230 form a volume through which the working fluid from the economizer 20 can be provided to the compression chamber 140. Thus the intermediate seals 230 sealingly engage between the upper portion 202A of the housing 202 and the non-orbiting scroll member 110.

In operation, the compressor 200 can receive an intermediate pressure working fluid via the economizer injection inlet 222 and provide that working fluid to the compression chamber 140 via the compression inlet ports 226, 228, where the working fluid is compressed and ultimately discharged via the discharge outlet 106.

In an embodiment, to ensure that working fluid is flowing into the compression chamber 140 via the compression inlet ports 226, 228, and not outward, the pressure of the working fluid at the compression inlet ports 226, 228 may generally be higher than the pressure of the working fluid in the compression chamber 140. In an embodiment, because pressure of the compression chamber 140 is cyclic in a scroll compressor, the pressure of the compression chamber 140 at the location of the compression inlet ports 226, 228 may briefly be less than the pressure of the working fluid at the compression inlet ports 226, 228. However, the intermediate pressure chamber 224 may reduce an impact of any pressure wave that could flow backwards from the normal flow direction. In an embodiment, a one-way valve (e.g., a check valve) could be included to ensure that working fluid cannot flow backwards from the normal flow direction.

The specific location of the compression inlet ports 226, 228 with respect to the compression process can be varied.

In an embodiment, the location of the compression inlet ports 226, 228 can be selected so that the pressure in the compression chamber 140 is relatively near the suction pressure (e.g., at a location in which compression is just beginning). In the illustrated embodiment, this is a location at a relatively outer extent of the compression chamber 140. In such an embodiment, the provision of the working fluid to the compression process can increase a capacity of the HVACR system, but may also increase energy required, which may reduce an efficiency of the HVACR system.

In an embodiment, the location of the compression inlet ports 226, 228 can be selected so that the pressure in the compression chamber 140 is relatively near the discharge pressure (e.g., at a location near discharge). In the illustrated embodiment, this is a location at a relatively inner extent of the compression chamber 140. In such an embodiment, the provision of the working fluid to the compression process can increase the efficiency of the HVACR system, but may only slightly improve the capacity of the HVACR system.

In an embodiment, the location of the compression inlet ports 226, 228 can be selected so that the pressure in the compression chamber 140 is between the suction pressure and the discharge pressure. The selection of the location of the compression inlet ports 226, 228 can accordingly be balanced between increasing capacity and maintaining efficiency. Such a location may be selected based on, for example, modeling the anticipated efficiency and capacity changes, testing to determine the optimal location, or combinations thereof.

The compression inlet ports 226, 228 can be bored or otherwise drilled or formed in the non-orbiting scroll member 110 of the compressor 200. In an embodiment, the non-orbiting scroll member 110 can be cast or otherwise manufactured to include the compression inlet ports 226, 228. The compression inlet ports 226, 228 can be designed to minimize a pressure drop of the working fluid having an intermediate pressure. For example, the diameter, the length, and combinations thereof can be controlled to provide the working fluid at, for example, a desired flowrate. Further, an orientation of the compression inlet ports 226, 228 can be controlled. For example, the compression inlet ports 226, 228 are oriented at an angle θ relative to a longitudinal axis L5 of the compressor 200. The angle θ can be measured along a longitudinal axis L8, L9 of the compression inlet ports 226, 228. In an embodiment, the angle θ can vary. In an embodiment, the angle θ can be 0°. In an embodiment, an angle of the compression inlet ports 126, 128 can also be varied with respect to a direction into or out from the page.

FIG. 6 is a top view of the compressor 200 in FIG. 5, according to an embodiment. As illustrated in FIG. 6, the economizer injection inlet 222 and the discharge outlet 106 are both formed in the upper portion 202A of the housing 202. The discharge outlet 106 is disposed centrally with respect to the compressor 200. The economizer injection inlet 222 is disposed offset from the center of the compressor 200. Line 5-5 is also shown in FIG. 6, indicating along which line the section of FIG. 5 is displayed.

Figure 7:
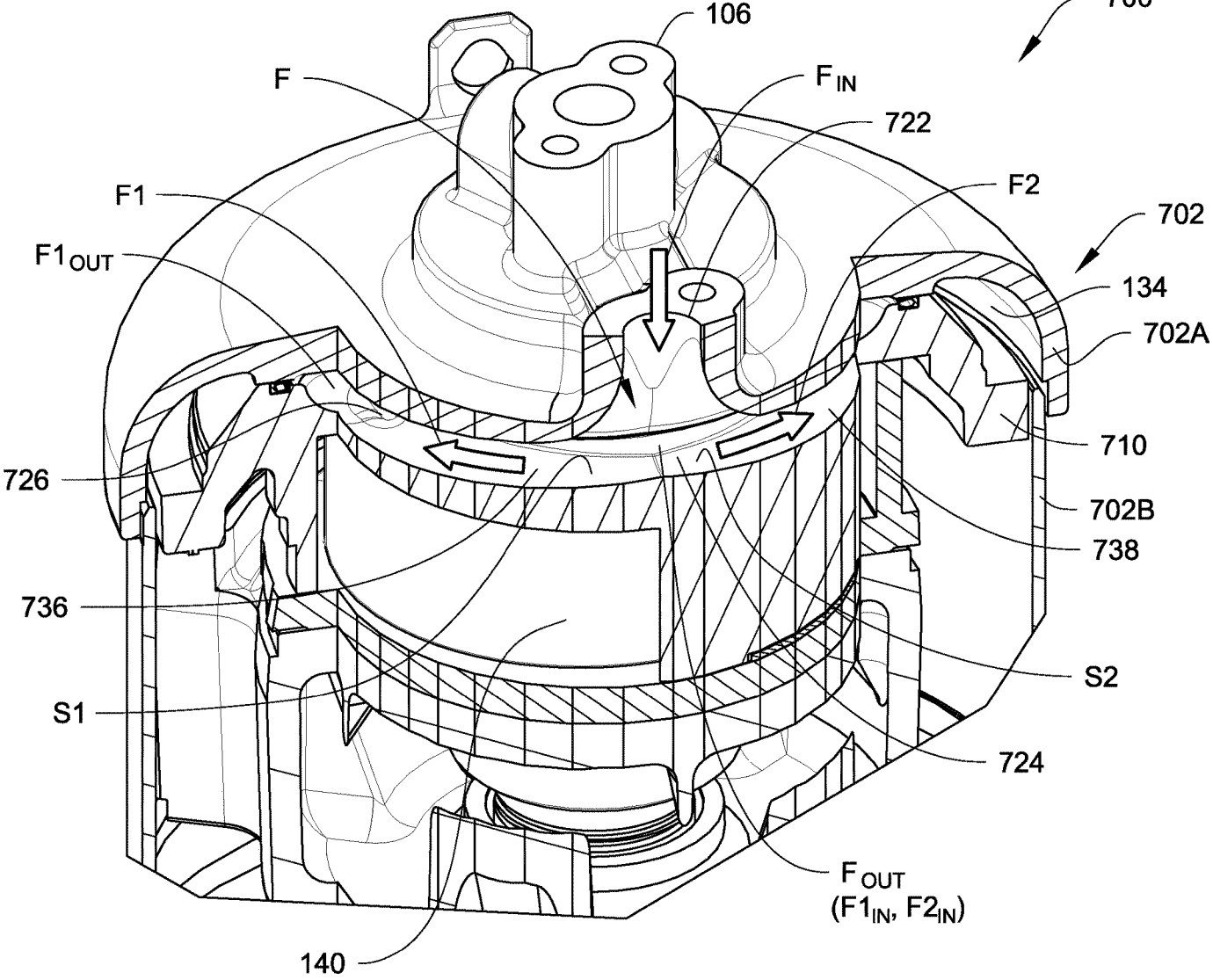
FIG. 7 is a perspective view of a partial cutaway of a compressor with helical channels, according to an embodiment.

FIG. 7 is a perspective view of a partial cutaway of a compressor 700 with a first helical channel 736 and a second helical channel 738, according to an embodiment. It is to be appreciated that the compressor 700 in some embodiments can have features similar to the compressor 50, the compressor 100, and/or the compressor 200, except as described below. For simplicity of this Specification, features identified by like reference numbers will not be described in further detail.

In an embodiment, the compressor 700 is a compressor in a refrigerant circuit for compressing a working fluid (e.g., the compressor 20 of the refrigerant circuit 10 in FIG. 1). It is to be appreciated that the compressor 700 includes additional features shown but not described in detail in this Specification. For example, the compressor 700 in an embodiment can include a lubricant sump for storing lubricant to be introduced to the moving features of the compressor 700.

The illustrated compressor 700 is a single stage scroll compressor. More specifically, the illustrated compressor 700 is a single-stage vertical scroll compressor. It is to be appreciated that the principles described in this Specification are not intended to be limited to single-stage scroll compressors and that they can be applied to multi-stage scroll compressors having two or more compression stages. Generally, the embodiments as disclosed in this Specification are suitable for a compressor with a vertical or a near vertical crankshaft. It is to be appreciated that the embodiments may also be applied to a horizontal compressor.

The compressor 700 includes a housing 702. The housing 702 includes an upper portion 702A and a lower portion 702B. The upper portion 702A can also be referred to as a cap. The upper portion 702A is an outermost portion of the housing 702 of the compressor 700. The upper portion 702A and a non-orbiting scroll member 710 form a volume therebetween, which is an intermediate pressure chamber 724. The lower portion 702B provides the remainder of the housing 702 for the compressor 700. The lower portion 702*b* can be referred to as a shell.

The compressor 700 includes an economizer injection inlet 722. The economizer injection inlet 722 is disposed in the upper portion 702A of the housing 702. In the illustrated embodiment, a longitudinal axis L6 of the economizer injection inlet 722 is parallel to an axis L5 of the driveshaft 114 (shown in FIG. 9). The economizer injection inlet 722 is configured to be fluidly connected to an economizer of the refrigerant circuit (e.g., the economizer 20 in FIG. 1). In an embodiment, the economizer injection inlet 722 and the discharge outlet 106 can be, for example, machined connections or tubes that are welded to the housing 702. In an embodiment, the housing 702, economizer injection inlet 722, and discharge outlet 106 can be a single piece, unitary construction.

The economizer injection inlet 722 is in fluid communication with a compression chamber 140 via a plurality of compression inlet ports 726, 728. The compression inlet port 728 is obscured in FIG. 7 (e.g., see FIGS. 10-12). In the illustrated embodiment in FIG. 7, the housing portion 702A forms a sealing engagement with the non-orbiting scroll member 710. The compression inlet ports 726, 728 are formed in the non-orbiting scroll member 710 of the compressor 700. Working fluid that has been compressed in the compression chamber 140 is discharged from the compressor 700 via the discharge outlet 106. The compressed working fluid (e.g., at a discharge pressure) is then provided to a condenser in the refrigerant circuit (e.g., to the condenser 14 via the refrigerant line 24 in FIG. 1).

In operation, the compressor 700 can receive an intermediate pressure working fluid via the economizer injection inlet 722 and provide the intermediate pressure working fluid to the compression chamber 140 via the compression inlet ports 726, 728. The intermediate pressure working fluid is then further compressed and ultimately discharged via the discharge outlet 106.

In an embodiment, to ensure that working fluid is flowing into the compression chamber 140 via the compression inlet ports 726, 728, and not outward, the pressure of the working fluid at the compression inlet ports 726, 728 may generally be higher than the pressure of the working fluid in the compression chamber 140. For example, the pressure of the working fluid at the first compression inlet port 726 may generally be higher than the pressure of the working fluid in the pressure pocket of the compression chamber 140 at the first compression inlet port 726. The pressure of the working fluid at the compression inlet ports 726, 728 is between the suction pressure and discharge pressure of the compression chamber 140.

In an embodiment, because pressure of the compression chamber 140 is cyclic in a scroll compressor, the pressure of the compression chamber 140 at the location of the compression inlet ports 726, 728 may briefly be less than the pressure of the working fluid at the compression inlet ports 726, 728. However, the intermediate pressure chamber 724 may reduce an impact of any pressure wave that could flow backwards from the normal flow direction.

In an embodiment, a one-way valve 770 (e.g., a check valve) may be included to ensure that working fluid cannot flow backwards from the normal flow direction.

The specific location and/or angle of the compression inlet ports 726, 728 with respect to the compression process and/or the angle of the compression inlet ports 726, 728 can vary in embodiments as similarly discussed above regarding the inlet ports 126, 128, 226, 228 of the compressors 100, 200.

As illustrated in FIG. 7, the intermediate pressure working fluid has a main flow path F entering into the intermediate pressure chamber 724. The main flow path F has an inlet end $F_{IN}$, where the intermediate pressure working fluid entering into the intermediate pressure chamber 724, and an outlet end $F_{OUT}$. The outlet end $F_{OUT}$ of the main flow path F diverges into a first portion F1 that follows a first circumferential direction D1 of the housing 702 (D1 shown in FIG. 8) and a second portion F2 that follows a second circumferential direction D2 of the housing 702 (D2 shown in FIG. 8). For example, the first circumferential direction D1 is opposite to the second circumferential direction D2. The main flow path F diverges into the inlet end $F_{IN}$ of the first portion F1 and the inlet end $F2_{IN}$ of the second portion F2. The inlet end $F1_{IN}$ of the first portion F1 and the inlet end $F2_{IN}$ of the second portion F2 diverge at the economizer injection inlet 722. An outlet end $F1_{OUT}$ of the first portion F1 and the outlet end $F2_{OUT}$ (obscured in FIG. 7) of the second portion F2 connect with the first compression inlet port 726 and the second compression inlet port 728, respectively.

The intermediate pressure chamber 724 has a first helical channel 736 that fluidly connects the economizer injection inlet 722 (alternatively referred as an economizer inlet) to the first compression inlet port 726. The first helical channel 736 defines the first portion F1 of the main flow path F. The first helical channel 736 has an inner surface S1 that is continuously curved to reduce or to eliminate sudden directional changes in the intermediate pressure working fluid flowing through the first helical channel 736. The reduction in the sudden directional changes reduces the pressure drop within the flow path and can allow the intermediate pressure working fluid to maintain more of its velocity from the economizer injection inlet 722 to a compression inlet port. The continuously curved inner surface reduces the pressure drop and/or velocity drop between the economizer injection inlet 722 and the first compressor inlet port 726.

The intermediate pressure chamber 724 also includes a second helical channel 738 that fluidly connects the economizer injection inlet 722 to the second compression inlet port 728. The second helical channel 738 defines the second portion F2 of the main flow path F. The second helical channel 738 having an inner surface S2 that is continuously curved to reduce or to eliminate sudden directional changes in to the intermediate pressure working fluid the second helical channel 738. The continuously curved inner surface S2 reduces the pressure drop and/or velocity drop between the economizer injection inlet 722 and the second compressor inlet port 728, as similarly discussed with respect to the first helical channel 736. In an embodiment, a helical channel 736, 738 was observed to have at or about a 10% increase in the flowrate over a non-helical channel.

The first helical channel 736 may represent a portion of a helix. The helix may be conical or circular. As shown in FIG. 7, the first helical channel 736 can extend less than a full turn of the helix (e.g., less than 360 degrees when viewed along the axis L5). In an embodiment, the first helical channel 736 can extend at least 70 degrees of a helix when viewed along the axis L5 (e.g., in top view, in bottom view, or the like). In an embodiment, the first helical channel 736 can extend at least 90 degrees of a helix when viewed along the axis L5. The second helical channel 738 may represent a portion of another helix that is conical or circular. The second helical channel 738 can, independently, extend along a helix as discussed above for the first helical channel 736 (e.g., less than full turn, at least 70 degrees, at least 90 degrees, or the like).

In an embodiment, the compressor 700 may include a single compression inlet port 726, 728. In such an embodiment, the intermediate chamber 724 may have a single helical channel 736, 738.

In an embodiment illustrated in FIG. 7, the first helical channel 736 descends axially while circumferentially following a circumferential curvature of the compressor housing 702. The first helical channel 736 descends axially from an axial position A1 of the economizer injection inlet 722 to an axial position A2 of the first compression inlet port 726. The axial descent may be completed gradually and continuously from the economizer injection inlet 722 to the compressor inlet port 726. In an embodiment, a rate of axial descent of the first helical channel 736 may be varied along a flow path of the helical channel.

The intermediate pressure chamber 140 can include a first helical channel 736 and a second helical channel 738. The first helical channel 736 fluidly connects an economizer injection inlet 722 to a first compression inlet port 726. The second compression inlet port 728 (shown in FIG. 12) fluidly connects the economizer injection inlet 722 to a second compression inlet port 728 (shown in FIG. 12). The first helical channel 736 follows one of the circumferential directions of the housing 702, and the second helical channel 738 follows the other of the circumferential directions of the housing 702.

Figure 8:
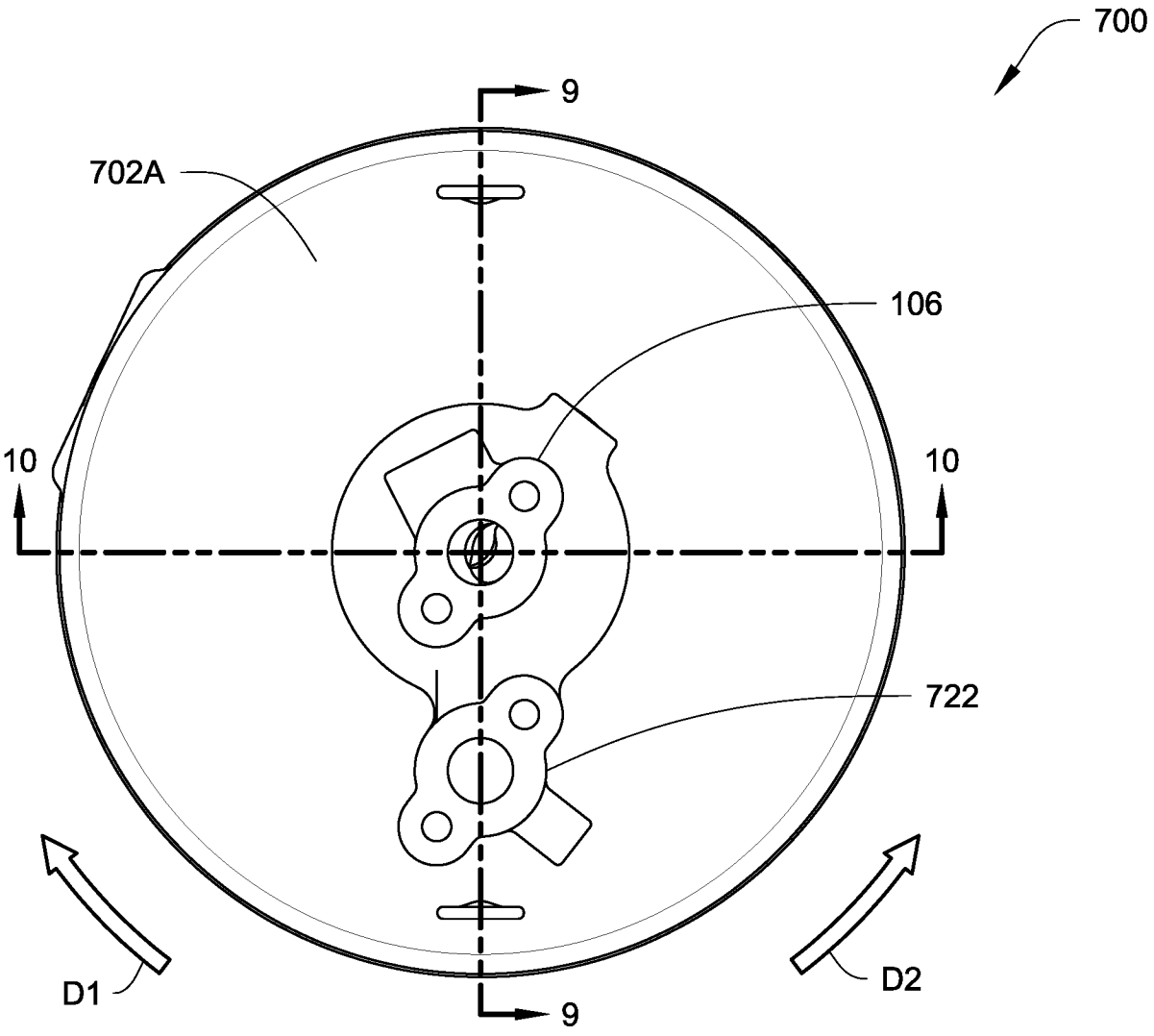
FIG. 8 is a top view of a compressor, according to an embodiment.

FIG. 8 is a top view of the compressor 700 in FIG. 7, according to an embodiment. As illustrated in FIG. 7, the economizer injection inlet 722 and the discharge outlet 106 are both formed in the upper portion 702A of the housing 702. In an embodiment, the discharge outlet 106 is disposed centrally with respect to the compressor 700. In an embodiment, the economizer injection inlet 722 is disposed offset from the center of the compressor 700.

Figure 9:
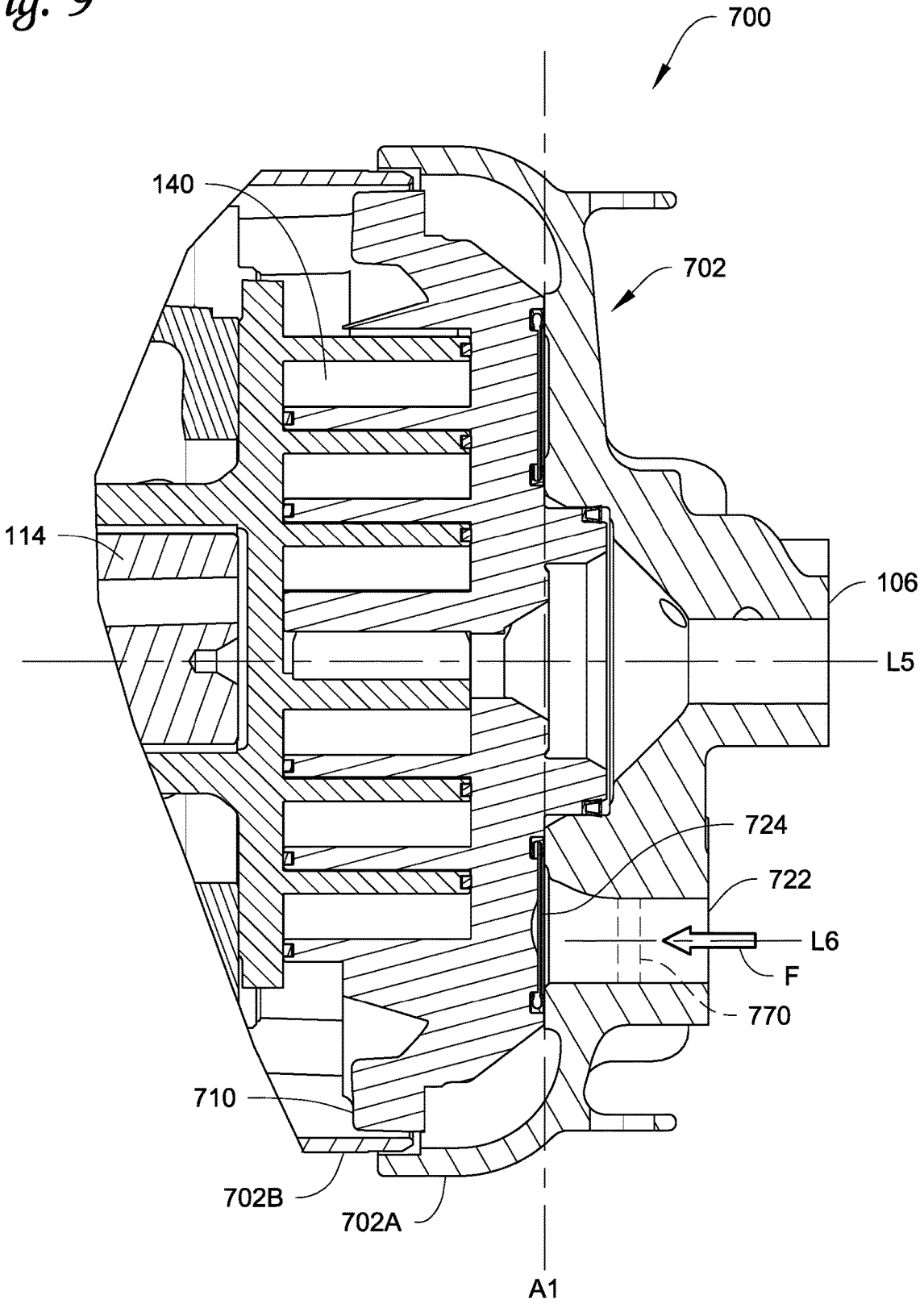
FIG. 9 is a sectional view of the compressor in FIG. 8 along line 9-9, according to an embodiment.

FIG. 9 is a partial cross sectional view of the compressor 700, according to an embodiment. The cross-sectional view is along the line 9-9 in FIG. 8. The intermediate pressure working fluid enters the intermediate pressure chamber 724 from the economizer injection inlet 722. The intermediate pressure working fluid having a flow path with the main flow path F and diverging into the first helical channel 736 and the second helical channel 738. As shown in FIG. 9, the inlet ends of the first helical channel 736 and the second helical channel 738 branch from the economizer inlet 722.

Figure 10:
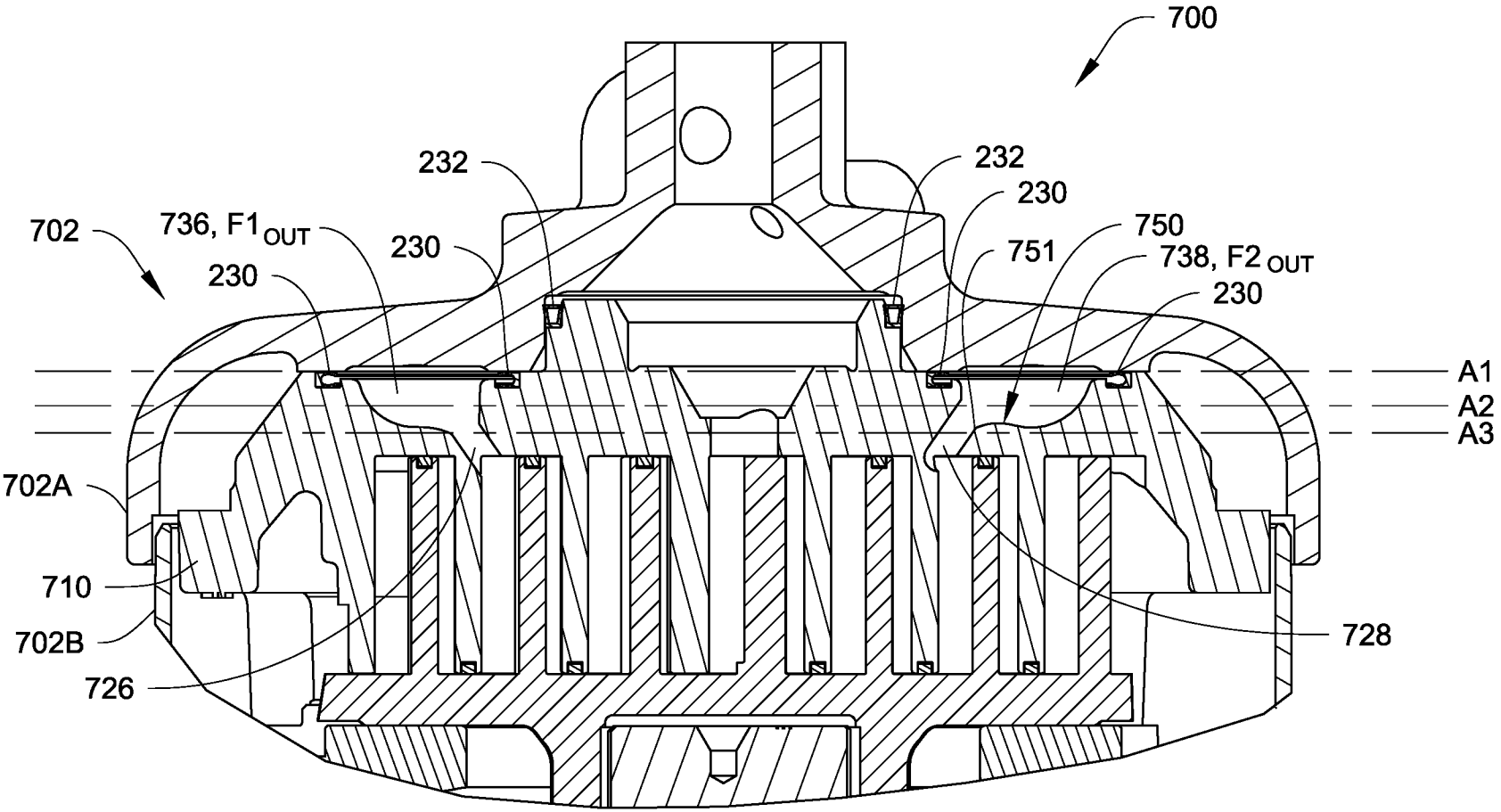
FIG. 10 is a sectional view of the compressor in FIG. 8 along the line 10-10, according to an embodiment.

FIG. 10 is a partial cross-sectional view of the compressor 700, according to an embodiment. The cross sectional view is along the line 10-10 of FIG. 8. The first helical channel 736 connects to the first compression inlet port 726 at the outlet end $F1_{OUT}$ of the first portion F1 of the main flow path F. The second helical channel 738 connects to the second compression inlet port 728 at the outlet end $F2_{OUT}$ of the second portion F2 of the main flow path F.

As similarly discussed above regarding the compressor 200, a discharge seal 232 (e.g., see FIG. 10) and intermediate seals 230 (e.g., see FIG. 10) can function to isolate the compression inlet ports 726, 728 from the discharge outlet 106 (e.g., working fluid at a discharge pressure) and a suction chamber 134 (e.g., working fluid at a suction pressure). The discharge seal 232 sealingly engages the upper portion 702A of the housing 702 and the non-orbiting scroll member 710. The intermediate seals 230 sealingly engage the upper portion 702A of the housing 702 and the non-orbiting scroll member 710. In the illustrated embodiment, there are two intermediate seals 230. The intermediate seals 230 can form/seal a volume (e.g., the intermediate pressure chamber 724) through which the working fluid from the economizer can be provided to the compression chamber 140. Thus, the intermediate seals 230 sealingly engage between the upper portion 702A of the housing 702 and the non-orbiting scroll member 710.

Figure 11:
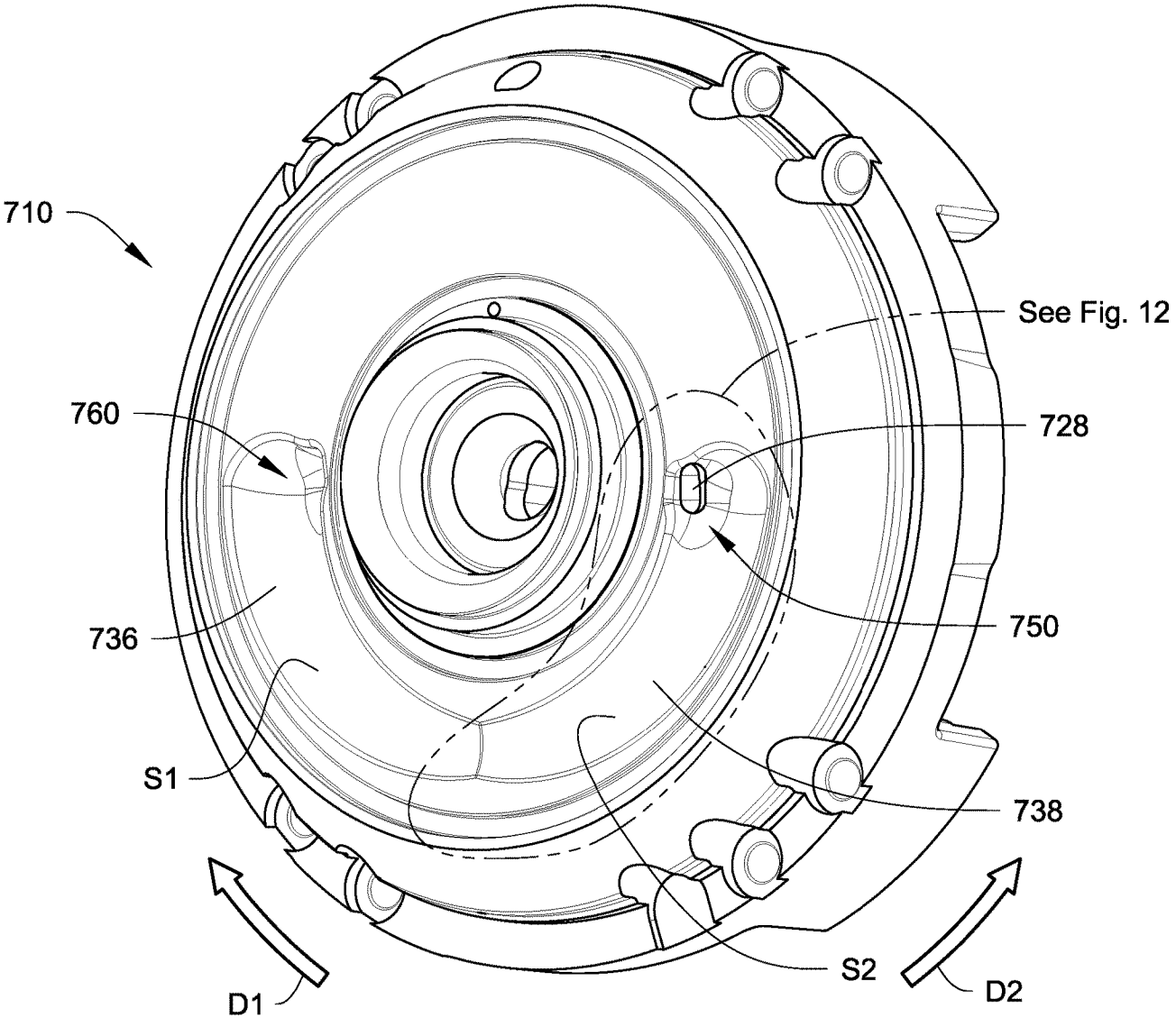
FIG. 11 is a perspective view of a non-orbital scroll member of a compressor, according to an embodiment.

FIG. 11 is a top perspective view of the non-orbiting scroll member 710 of the housing 702 of the compressor 700, according to an embodiment. The non-orbiting scroll member 710 as illustrated in FIG. 11 shows a portion of the inner surface S1 of the first helical channel 736 and a portion of the inner surface S2 of the second helical channel 738. In an embodiment and as shown in FIG. 11, the inner surface S2 of the second helical channel 738 connects to the second compression inlet port 728 at a second transition portion 750. The second transition portion 750 can be formed in non-orbiting scroll member 710.

As shown in FIG. 11, each helical channel 736, 738 has a circumferential curvature. The circumferential curvature of the first helical channel 736 may follow the first circumferential direction D1 of the compressor housing 702. The circumferential curvature of the second helical channel 738 may follow the second circumferential direction D2 of the compressor housing.

As shown in FIG. 11, the non-orbiting scroll member 710 can also include a first transition portion 760 that connects the inner surface S1 of the first helical channel 736 to the first compression inlet 728. The first transition portion 760 for the first compression inlet 726 can have a similar configuration as discussed with respect to the second transition portion 750 for the second compression inlet 728.

Figure 12:
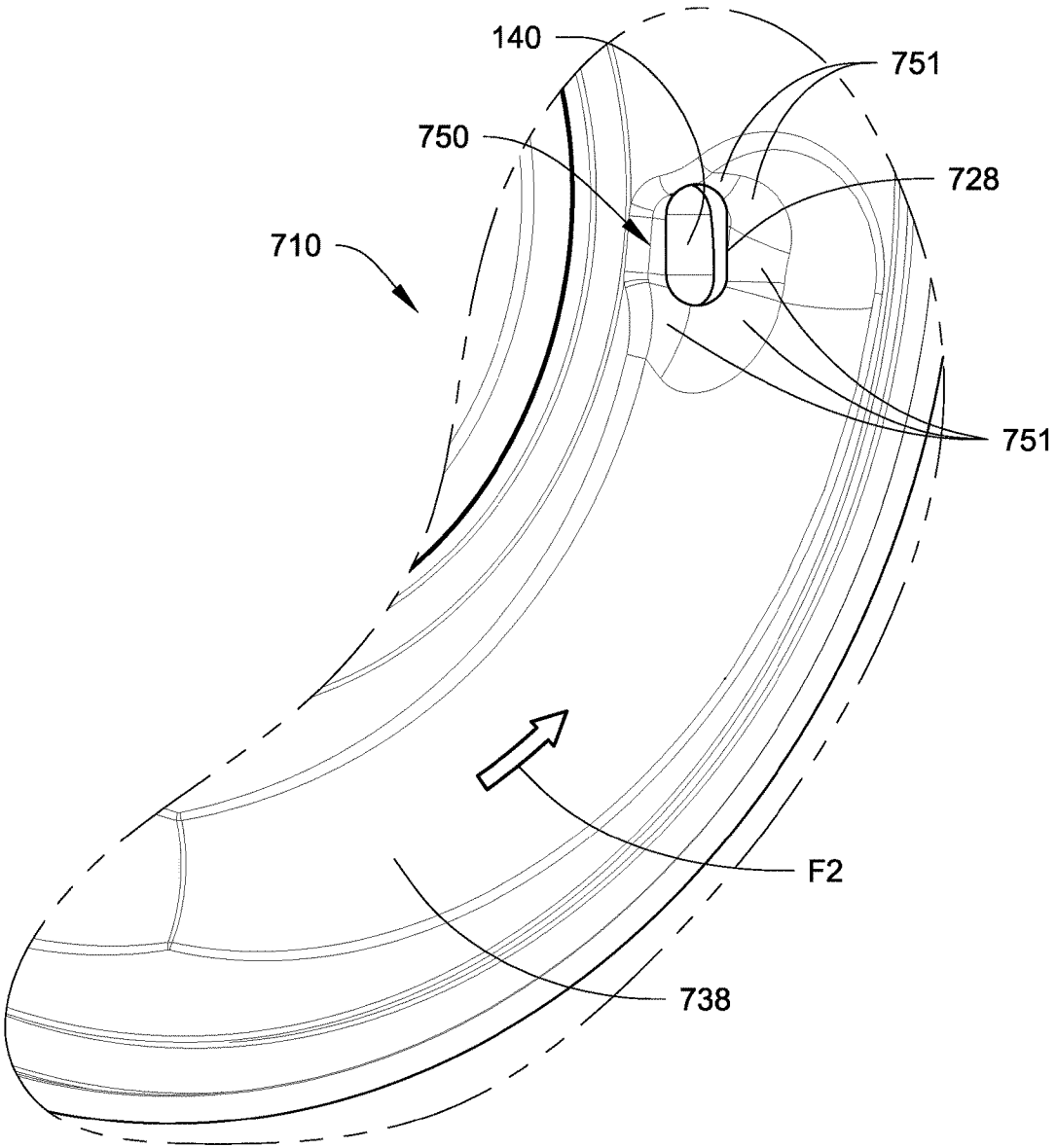
FIG. 12 is an enlarged partial view of the non-orbiting scroll member of the compressor in FIG. 11, according to an embodiment.

FIG. 12 is an enlarged view of the second helical channel 738 in FIG. 11. As shown in FIG. 10 and FIG. 12, the second transition portion 750 has a plurality of convex and concave transitions 751. The transitions 751 guide the second portion F2 of the main flow path F from an axial position A2 (see FIG. 10) of the second helical channel 738 to an axial position A3 (see FIG. 10) of the second compression inlet port 728. The transitions 751 guide the second portion F2 axially, radially, and/or circumferentially from the second helical channel 738 (partially shown in FIG. 12) into the intermediate compression chamber 140. The transitions 751 can reduce sudden directional changes from the second helical channel 728 into the second compressor inlet port 728 and therefore reduce the pressure drop and/or velocity drop from the second helical channel 738 to the second compression inlet port 728.

According to one embodiment, the transitions 751 form a "kidney bean" shape in the non-orbiting scroll member 710. As shown in FIG. 10, the transitions 751 form a kidney bean shape when viewed along the axis L5 (as shown in FIG. 9) in a direction from axial positions A1 to A3 (as shown in FIG. 10). The "kidney bean" shape connects the second helical channel 738 with the second compression inlet port 728. The kidney bean shape of the transitions 751 provide continuously curved surfaces that from the second helical channel 738 into the second compression inlet 738 such that the flow path of the process fluid gradually descends into the second compression inlet ports 728. The working fluid is guided circumferentially, axially, and/or radially towards the second compression inlet port 728. As the result, the transition into the second compression inlet port 728 occurs gradually without any sudden directionally change(s) and with enters the compression chamber 140 with higher pressure and/or at a higher flowrate.

Aspects

It is noted that any one of aspects 1-7 can be combined with any one of aspects 8-51. Any one of aspects 8-14 can be combined with any one of aspects 15-51. Any one of aspects 15-20 can be combined with aspect 21-51. Aspect 21 can be combined with any of aspects 22-51. Any one of aspects 22-31 can be combined with any of aspects 32-51. Any of aspects 32-41 can be combined with any of aspects 42-51.

Aspect 1. A scroll compressor, comprising: a compressor housing; an orbiting scroll member disposed within the compressor housing; a non-orbiting scroll member disposed within the compressor housing, wherein the orbiting scroll member and the non-orbiting scroll member are intermeshed thereby forming a compression chamber within the housing, the non-orbiting scroll including a plurality of compression inlet ports; an economizer injection inlet formed through the compressor housing and in fluid communication with the compression chamber via the compression inlet ports; and a discharge outlet in fluid communication with the compression chamber.

Aspect 2. The compressor of aspect 1, further comprising an intermediate pressure chamber formed in the compressor housing between the non-orbiting scroll member and the compressor housing.

Aspect 3. The compressor of aspect 2, wherein the intermediate pressure chamber is fluidly connected to the economizer injection inlet and the compression inlet ports.

Aspect 4. The compressor of any one of aspects 1-3, wherein the compression inlet ports are in fluid communication with the compression chamber at a location wherein the working fluid being compressed is between a suction pressure and between a discharge pressure.

Aspect 5. The compressor of any one of aspects 1-4, wherein the economizer injection inlet has a longitudinal axis, the longitudinal axis of the economizer injection inlet is parallel to a longitudinal axis of the discharge outlet.

Aspect 6. The compressor of any one of aspects 1-5, wherein the discharge outlet has a longitudinal axis, the longitudinal axis of the discharge outlet being parallel to a longitudinal axis of a driveshaft of the scroll compressor.

Aspect 7. The compressor of any one of aspects 1-6, wherein the scroll compressor is a single-stage, vertical scroll compressor.

Aspect 8. A heating, ventilation, air conditioning, and refrigeration (HVACR) system, comprising: a refrigerant circuit, including: a compressor, a condenser, an expansion device, an economizer, and an evaporator, fluidly connected, wherein a working fluid flows therethrough, and wherein the compressor is a scroll compressor, the scroll compressor including: a compressor housing; an orbiting scroll member disposed within the compressor housing; a non-orbiting scroll member disposed within the compressor housing, wherein the orbiting scroll member and the non-orbiting scroll member are intermeshed thereby forming a compression chamber within the compressor housing, the non-orbiting scroll including a plurality of compression inlet ports; an economizer injection inlet formed through the compressor housing and in fluid communication with the compression chamber via the compression inlet ports; and a discharge outlet in fluid communication with the compression chamber.

Aspect 9. The system of aspect 8, further comprising an intermediate pressure chamber formed in the compressor housing between the non-orbiting scroll member and the compressor housing.

Aspect 10. The system of aspect 9, wherein the intermediate pressure chamber is fluidly connected to the economizer injection inlet and the compression inlet ports.

Aspect 11. The system of any one of aspects 8-10, wherein the compression inlet ports are in fluid communication with the compression chamber at a location wherein the working fluid being compressed is between a suction pressure and between a discharge pressure.

Aspect 12. The system of any one of aspects 8-11, wherein the economizer injection inlet has a longitudinal axis, the longitudinal axis of the economizer injection inlet is parallel to a longitudinal axis of the discharge outlet.

Aspect 13. The system of any one of aspects 8-12, wherein the discharge outlet has a longitudinal axis, the longitudinal axis of the discharge outlet being parallel to a longitudinal axis of a driveshaft of the scroll compressor.

Aspect 14. The system of any one of aspects 8-13, wherein the compressor is a single-stage, vertical scroll compressor.

Aspect 15. A scroll compressor, comprising: a compressor housing having a plurality of portions including an upper housing portion and a lower housing portion; an orbiting scroll member disposed within the compressor housing; a non-orbiting scroll member disposed within the compressor housing, wherein the orbiting scroll member and the non-orbiting scroll member are intermeshed thereby forming a compression chamber within the compressor housing, the non-orbiting scroll including a plurality of compression inlet ports; an economizer injection inlet formed through the upper housing portion and in fluid communication with the compression chamber via the compression inlet ports; and a discharge outlet in fluid communication with the compression chamber and formed through the upper housing, wherein the upper housing portion and the non-orbiting scroll member are sealingly engaged, thereby forming an intermediate pressure chamber therebetween.

Aspect 16. The compressor of aspect 15, further comprising a seal disposed between the upper housing portion and the non-orbiting scroll member.

Aspect 17. The compressor one of aspects 15 or 16, wherein the compression inlet ports have a longitudinal axis that is angled relative to a longitudinal axis of the scroll compressor.

Aspect 18. The compressor of any one of aspects 15-17, wherein a longitudinal axis of the discharge outlet and a longitudinal axis of a driveshaft of the scroll compressor are coaxial.

Aspect 19. The compressor of any one of aspects 15-18, wherein the compression inlet ports are disposed at a location of the compression chamber at which the working fluid being compressed is between a suction pressure and between a discharge pressure.

Aspect 20. The compressor of any one of aspects 15-19, wherein the economizer injection inlet has a longitudinal axis, the longitudinal axis of the economizer injection inlet is parallel to a longitudinal axis of the discharge outlet.

Aspect 21. A method, comprising: providing an intermediate pressure chamber in a scroll compressor, the intermediate pressure chamber being formed in a location between a non-orbiting scroll member of the scroll compressor and an upper housing portion of the scroll compressor, the intermediate pressure chamber configured to receive a working fluid at an intermediate pressure from an economizer and provide the working fluid to a compression chamber of the scroll compressor via a plurality of compression injection ports.

Aspect 22. A scroll compressor, comprising: a compressor housing; an orbiting scroll member disposed within the compressor housing; a non-orbiting scroll member disposed within the compressor housing, wherein the orbiting scroll member and the non-orbiting scroll member are intermeshed thereby forming a compression chamber within the compressor housing, the non-orbiting scroll including a plurality of compression inlet ports; an economizer injection inlet formed through the compressor housing and in fluid communication with the compression chamber via the compression inlet ports; a discharge outlet in fluid communication with the compression chamber; and an intermediate pressure chamber formed in the compressor housing between the non-orbiting scroll member and the compressor housing, the intermediate pressure chamber including a first helical channel, wherein the plurality of compression inlet ports includes a first compression inlet port, the first helical channel fluidly connecting the economizer injection inlet to the first compression inlet port, and first helical channel configured to direct a first portion of working fluid from the economizer injection inlet to the first compression inlet ports.

Aspect 23. The compressor of aspect 22, wherein the first helical channel has a continuously curved surface.

Aspect 24. The compressor of any one of aspects 22 and 23, wherein the first helical channel has a circumferential curvature following a circumferential curvature of the compressor housing in a first circumferential direction.

Aspect 25. The compressor of any one of aspects 22-24, wherein the first helical channel descents axially from the economizer injection inlet to the first compression inlet port.

Aspect 26. The compressor of any one of aspects 22-25, wherein a helical shape of the first helical channel extends for less than a full turn.

Aspect 27. The compressor of any one of aspects 22-26, wherein the plurality of compression inlet ports includes a second compression inlet port, the intermediate pressure chamber includes a second helical channel that connects the economizer injection inlet to the second compression inlet port, the second helical channel configured to direct a second portion of the working fluid from the economizer injection inlet to the second compression inlet port, and Aspect 28. The compressor of aspect 27, wherein the second helical channel having a continuously curved surface.

Aspect 29. The compressor of any one of aspects 27 and 28, wherein a helical shape of the second helical channel has a circumferential curvature following a circumferential curvature of the compressor housing in a second circumferential direction, the second helical shape descends axially from the economizer injection inlet to the second compression inlet port, Aspect 30. The compressor any one of aspects 27-29, wherein the second helical channel extends for less than a full turn, and Aspect 31. The compressor any one of aspects 27-30, wherein the first helical channel and second helical channel diverge from the economizer injection inlet.

Aspect 32. A heating, ventilation, air conditioning, and refrigeration (HVACR) system, comprising: a refrigerant circuit, including: a compressor, a condenser, an expansion device, an economizer, and an evaporator, fluidly connected, wherein a working fluid flows therethrough, and wherein the compressor is a scroll compressor, the scroll compressor including: a compressor housing; an orbiting scroll member disposed within the compressor housing; a non-orbiting scroll member disposed within the compressor housing, wherein the orbiting scroll member and the non-orbiting scroll member are intermeshed thereby forming a compression chamber within the compressor housing, the non-orbiting scroll including a plurality of compression inlet ports; an economizer injection inlet formed through the compressor housing and in fluid communication with the compression chamber via the compression inlet ports; a discharge outlet in fluid communication with the compression chamber; and an intermediate pressure chamber formed in the compressor housing between the non-orbiting scroll member and the compressor housing, the intermediate pressure chamber including a first helical channel, wherein the plurality of compression inlet ports includes a first compression inlet port, the first helical channel fluidly connecting the economizer injection inlet to the first compression inlet port, and first helical channel configured to direct a first portion of the working fluid from the economizer injection inlet to the first compression inlet ports.

Aspect 33. The HVACR system of aspect 32, wherein the first helical channel has a continuously curved surface.

Aspect 34. The HVACR system of any one of aspects 32 and 33, wherein the first helical channel has a circumferential curvature following a circumferential curvature of the compressor housing in a first circumferential direction.

Aspect 35. The HVACR system of any one of aspects 32-34, wherein the first helical channel descents axially from the economizer injection inlet to the first compression inlet port.

Aspect 36. The HVACR system of any one of aspects 32-35, wherein a helical shape of the first helical channel extends for less than a full turn.

Aspect 37. The HVACR system of any one of aspects 32-36, wherein the plurality of compression inlet ports includes a second compression inlet port, the intermediate pressure chamber includes a second helical channel that connects the economizer injection inlet to the second compression inlet port, the second helical channel configured to direct a second portion of the working fluid from the economizer injection inlet to the second compression inlet port, and Aspect 38. The HVACR system of aspect 37, wherein the second helical channel having a continuously curved surface.

Aspect 39. The HVACR system of any one of aspects 37 and 38, wherein a helical shape of the second helical channel has a circumferential curvature following a circumferential curvature of the compressor housing in a second circumferential direction, the second helical shape descends axially from the economizer injection inlet to the second compression inlet port, Aspect 40. The HVACR system of any one of aspects 37-39, wherein the second helical channel extends for less than a full turn, and Aspect 41. The HVACR system of any one of aspects 37-40, wherein the first helical channel and second helical channel diverge from the economizer injection inlet.

Aspect 42. A scroll compressor, comprising: a compressor housing having a plurality of portions including an upper housing portion and a lower housing portion; an orbiting scroll member disposed within the compressor housing; a non-orbiting scroll member disposed within the compressor housing, wherein the orbiting scroll member and the non-orbiting scroll member are intermeshed thereby forming a compression chamber within the compressor housing, the non-orbiting scroll including a plurality of compression inlet ports; an economizer injection inlet formed through the upper housing portion and in fluid communication with the compression chamber via the compression inlet ports; and a discharge outlet in fluid communication with the compression chamber, wherein the upper housing portion and the non-orbiting scroll member are sealingly engaged, thereby forming an intermediate pressure chamber therebetween, the intermediate pressure chamber including a first helical channel, and the plurality of compression inlet ports includes a first compression inlet port, the first helical channel fluidly connecting the economizer injection inlet to the first compression inlet port, and first helical channel configured to direct a first portion of the working fluid from the economizer injection inlet to the first compression inlet ports.

Aspect 43. The scroll compressor of aspect 42, wherein the first helical channel has a continuously curved surface.

Aspect 44. The scroll compressor of any one of aspects 42 and 43, wherein the first helical channel has a circumferential curvature following a circumferential curvature of the compressor housing in a first circumferential direction.

Aspect 45. The scroll compressor of any one of aspects 42-44, wherein the first helical channel descents axially from the economizer injection inlet to the first compression inlet port.

Aspect 46. The scroll compressor of any one of aspects 42-45, wherein a helical shape of the first helical channel extends for less than a full turn.

Aspect 47. The scroll compressor of any one of aspects 42-46, wherein the plurality of compression inlet ports includes a second compression inlet port, the intermediate pressure chamber includes a second helical channel that connects the economizer injection inlet to the second compression inlet port, the second helical channel configured to direct a second portion of the working fluid from the economizer injection inlet to the second compression inlet port, and Aspect 48. The scroll compressor of aspect 47, wherein the second helical channel having a continuously curved surface.

Aspect 49. The scroll compressor of any one of aspects 47 and 48, wherein a helical shape of the second helical channel has a circumferential curvature following a circumferential curvature of the compressor housing in a second circumferential direction, the second helical shape descends axially from the economizer injection inlet to the second compression inlet port, Aspect 50. The scroll compressor of any one of aspects 47-49, wherein the second helical channel extends for less than a full turn, and Aspect 51. The scroll compressor of any one of aspects 47-50, wherein the first helical channel and second helical channel diverge from the economizer injection inlet.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A scroll compressor, comprising:

a compressor housing;

an orbiting scroll member disposed within the compressor housing;

a non-orbiting scroll member disposed within the compressor housing, wherein the orbiting scroll member and the non-orbiting scroll member are intermeshed thereby forming a compression chamber within the compressor housing, the non-orbiting scroll including one or more compression inlet ports;

an economizer injection inlet formed through the compressor housing and in fluid communication with the compression chamber via the one or more compression inlet ports;

a discharge outlet in fluid communication with the compression chamber; and an intermediate pressure chamber formed in the compressor housing between the non-orbiting scroll member and the compressor housing, the intermediate pressure chamber including a first helical channel, wherein the one or more compression inlet ports include a first compression inlet port, the first helical channel fluidly connecting the economizer injection inlet to the first compression inlet port, and the first helical channel configured to direct a first portion of working fluid from the economizer injection inlet to the first compression inlet port.

2. The compressor of claim 1, wherein the first helical channel has a continuously curved surface.

3. The compressor of claim 1, wherein the first helical channel has a circumferential curvature following a circumferential curvature of the compressor housing in a first circumferential direction.

4. The compressor of claim 1, wherein the first helical channel descends axially from the economizer injection inlet to the first compression inlet port.

5. The compressor of claim 1, wherein a helical shape of the first helical channel extends for less than a full turn.

6. The compressor of claim 1, wherein the one or more compression inlet ports include a second compression inlet port, the intermediate pressure chamber includes a second helical channel that connects the economizer injection inlet to the second compression inlet port, the second helical channel configured to direct a second portion of the working fluid from the economizer injection inlet to the second compression inlet port, and the second helical channel having a continuously curved surface.

7. The compressor of claim 6, wherein a helical shape of the second helical channel has a circumferential curvature following a circumferential curvature of the compressor housing in a second circumferential direction, the second helical shape descends axially from the economizer injection inlet to the second compression inlet port, the second helical channel extends for less than a full turn, and the first helical channel and second helical channel diverge from the economizer injection inlet.

8. A heating, ventilation, air conditioning, and refrigeration (HVACR) system, comprising:

a refrigerant circuit, including:

a compressor, a condenser, an expansion device, an economizer, and an evaporator, fluidly connected, wherein a working fluid flows therethrough, and wherein the compressor is a scroll compressor, the scroll compressor including:

a compressor housing;

an orbiting scroll member disposed within the compressor housing;

a non-orbiting scroll member disposed within the compressor housing, wherein the orbiting scroll member and the non-orbiting scroll member are intermeshed thereby forming a compression chamber within the compressor housing, the non-orbiting scroll including one or more compression inlet ports;

an economizer injection inlet formed through the compressor housing and in fluid communication with the compression chamber via the one or more compression inlet ports;

a discharge outlet in fluid communication with the compression chamber; and an intermediate pressure chamber formed in the compressor housing between the non-orbiting scroll member and the compressor housing, the intermediate pressure chamber including a first helical channel, wherein the one or more compression inlet ports include a first compression inlet port, the first helical channel fluidly connecting the economizer injection inlet to the first compression inlet port, and the first helical channel configured to direct a first portion of the working fluid from the economizer injection inlet to the first compression inlet port.

9. The HVACR system of claim 8, wherein the first helical channel has a continuously curved surface.

10. The HVACR system of claim 8, wherein the first helical channel has a circumferential curvature following a circumferential curvature of the compressor housing in a first circumferential direction.

11. The HVACR system of claim 8, wherein the first helical channel descends axially from the economizer injection inlet to the first compression inlet port.

12. The HVACR system of claim 8, wherein a helical shape of the first helical channel extends for less than a full turn.

13. The HVACR system of claim 8, wherein the one or more compression inlet ports include a second compression inlet port, the intermediate pressure chamber includes a second helical channel that connects the economizer injection inlet to the second compression inlet port, the second helical channel configured to direct a second portion of the working fluid entering the economizer injection inlet to the second compression inlet port, and the second helical channel having a continuously curved surface.

14. The HVACR system of claim 13, wherein a helical shape of the second helical channel has a circumferential curvature following a circumferential curvature of the compressor housing in a second circumferential direction, the second helical shape descends axially from the economizer injection inlet to the second compression inlet port, the second helical channel extends for less than a full turn, and the first helical channel and second helical channel diverge from the economizer injection inlet.

15. A scroll compressor, comprising:

a compressor housing having a plurality of portions including an upper housing portion and a lower housing portion;

an orbiting scroll member disposed within the compressor housing;

a non-orbiting scroll member disposed within the compressor housing, wherein the orbiting scroll member and the non-orbiting scroll member are intermeshed thereby forming a compression chamber within the compressor housing, the non-orbiting scroll including one or more compression inlet ports;

an economizer injection inlet formed through the upper housing portion and in fluid communication with the compression chamber via the one or more compression inlet ports; and a discharge outlet in fluid communication with the compression chamber, and wherein the upper housing portion and the non-orbiting scroll member are sealingly engaged, thereby forming an intermediate pressure chamber therebetween, the intermediate pressure chamber including a first helical channel, and the one or more compression inlet ports include a first compression inlet port, the first helical channel fluidly connecting the economizer injection inlet to the first compression inlet port, and the first helical channel configured to direct a first portion of the working fluid from the economizer injection inlet to the first compression inlet port.

16. The scroll compressor of claim 15, wherein the first helical channel has a continuously curved surface.

17. The scroll compressor of claim 15, wherein the first helical channel has a circumferential curvature following a circumferential curvature of the compressor housing in a first circumferential direction.

18. The scroll compressor of claim 15 wherein the first helical channel descends axially from the economizer injection inlet to the first compression inlet port.

19. The scroll compressor of claim 15, wherein a helical shape of the first helical channel extends for less than a full turn.

20. The scroll compressor of claim 15, wherein the one or more compression inlet ports include a second compression inlet port, the intermediate pressure chamber includes a second helical channel that connects the economizer injection inlet to the second compression inlet port, the second helical channel configured to direct a second portion of the working fluid from the economizer injection inlet to the second compression inlet port, and the second helical channel having a continuously curved surface.

* * * * *